US007432223B2

(12) United States Patent
Hayakawa et al.

(10) Patent No.: US 7,432,223 B2
(45) **Date of Patent: *Oct. 7, 2008**

(54) REVERSIBLE THERMOSENSITIVE RECORDING MEDIUM, INFORMATION STORAGE MATERIAL, REVERSIBLE THERMOSENSITIVE RECORDING LABEL, IMAGE PROCESSING METHOD AND IMAGE PROCESSING DEVICE

(75) Inventors: Kunio Hayakawa, Mishima (JP); Shinya Kawahara, Numazu (JP); Hitoshi Shimbo, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 468 days.

This patent is subject to a terminal disclaimer.

(21) Appl. No.: 11/015,960

(22) Filed: Dec. 17, 2004

(65) Prior Publication Data

US 2005/0137088 A1 Jun. 23, 2005

(30) Foreign Application Priority Data

Dec. 18, 2003 (JP) ..... 2003-420942

(51) Int. Cl.
*B41M 5/42* (2006.01)

(52) U.S. Cl. ..... 503/201; 346/135.1; 503/207; 503/216; 503/226

(58) Field of Classification Search ..... None
See application file for complete search history.

(56) References Cited

U.S. PATENT DOCUMENTS 4,880,762 A 11/1989 Iiyama et al.
4,925,828 A 5/1990 Iiyama et al.
4,940,691 A 7/1990 Iiyama et al.
4,978,651 A 12/1990 Furuya et al.

(Continued)

FOREIGN PATENT DOCUMENTS

EP 1 016 547 A 7/2000

(Continued)

OTHER PUBLICATIONS

Patent Abstracts of Japan, vol. 1996, No. 02(Feb. 29, 1996), Abstract of JP 07 257036 A, Oct. 9, 1995, Mitsubishi Paper Mills Ltd.

(Continued)

*Primary Examiner*—Bruce H Hess
(74) *Attorney, Agent, or Firm*—Cooper & Dunham LLP

(57) ABSTRACT

A reversible thermosensitive recording medium including a substrate, a reversible thermosensitive recording layer and an intermediate layer. The reversible thermosensitive recording layer is configured to reversibly record and erase an image therein and disposed overlying the substrate and includes a binder resin and a reversible thermosensitive coloring composition. The reversible thermosensitive coloring composition includes an electron donating coloring compound and an electron accepting compound. The intermediate layer includes another binder resin and a content of hollow particles having a hollow ratio not less than 70% and a ratio of a maximum particle diameter thereof to a 50% cumulative particle diameter of from 2.0 to 3.0. The reversible thermosensitive recording layer achieves a colored state when heated to a temperature not lower than a melting point thereof, and achieves a discolorization state when heated to a temperature lower than the melting point. The reversible thermosensitive recording layer has an erasable energy range width of at least 0.1 mJ/dot when using a thermal head.

24 Claims, 4 Drawing Sheets

U.S. PATENT DOCUMENTS

| | | | |
|---|---|---|---|
| 4,981,970 | A | 1/1991 | Iiyama et al. |
| 4,985,345 | A | 1/1991 | Hayakawa et al. |
| 5,024,699 | A | 6/1991 | Ilyama et al. |
| 5,126,486 | A | 6/1992 | Furuya et al. |
| 5,306,887 | A | 4/1994 | Furuya et al. |
| 5,446,011 | A | 8/1995 | Hayakawa et al. |
| 5,447,900 | A | 9/1995 | Suzaki et al. |
| 5,489,501 | A | 2/1996 | Torii et al. |
| 6,180,560 | B1 | 1/2001 | Hayakawa et al. |
| 6,265,344 | B1 | 7/2001 | Shimbo et al. |
| 6,395,680 | B1 | 5/2002 | Morita et al. |
| 6,417,137 | B1 | 7/2002 | Suzaki et al. |
| 6,693,061 | B2 | 2/2004 | Shimbo et al. |
| 6,710,015 | B2 | 3/2004 | Kaneko et al. |
| 2003/0060366 | A1 | 3/2003 | Kaneko et al. |
| 2003/0153460 | A1 | 8/2003 | Morita et al. |
| 2004/0071187 | A1 | 4/2004 | Hayakawa et al. |
| 2004/0087444 | A1 | 5/2004 | Naruse et al. |

FOREIGN PATENT DOCUMENTS

| | | | |
|---|---|---|---|
| EP | 1 211 090 | A | 6/2002 |
| EP | 1 234 681 | A | 8/2002 |
| JP | 60-193691 | | 10/1985 |
| JP | 61-237684 | | 10/1986 |
| JP | 62-138556 | | 6/1987 |
| JP | 62-138568 | | 6/1987 |
| JP | 62-140881 | | 6/1987 |
| JP | 63-107584 | | 5/1988 |
| JP | 63-173684 | | 7/1988 |
| JP | 02-188293 | | 7/1990 |
| JP | 02-188294 | | 7/1990 |
| JP | 04-078573 | | 3/1992 |
| JP | 05-124360 | | 5/1993 |
| JP | 06-210954 | | 8/1994 |
| JP | 06-340174 | | 12/1994 |
| JP | 07-228050 | | 8/1995 |
| JP | 07-257036 | | 10/1995 |
| JP | 08-183254 | | 7/1996 |
| JP | 10-052976 | | 2/1998 |
| JP | 10-095175 | | 4/1998 |
| JP | 2000-024488 | | 1/2000 |
| JP | 2003-011514 | | 1/2003 |
| WO | WO 99/43758 | | 9/1999 |
| WO | WO 99/46320 | | 9/1999 |

OTHER PUBLICATIONS

Patent Abstracts of Japan, vol. 1995, No. 11 (Dec. 26, 1995), abstract of JP 07 228950 A, Aug. 29, 1995, Hitachi Metals Ltd.

Database WP1, Section CH, Week 199509, Derwent Publ's Ltd., London, ch A89, AN 1995-063644, XP002328951, abstract of JP 06 340174A, Dec. 13, 1994, Mitsubishi Paper Mills Ltd.

European Patent Office, Communication Pursuant to Article 96(2) EPC dated Jan. 30, 2007 in European Patent Application No. 04 030 157.4—1251 (Ricoh Company, Ltd.).

REVERSIBLE THERMOSENSITIVE RECORDING MEDIUM, INFORMATION STORAGE MATERIAL, REVERSIBLE THERMOSENSITIVE RECORDING LABEL, IMAGE PROCESSING METHOD AND IMAGE PROCESSING DEVICE

BACKGROUND OF THE INVENTION

1. Field of the Invention

The present invention relates to a reversible thermosensitive recording medium which can reversibly perform a coloring reaction and an erasure reaction by applying heat to a reversible thermosensitive coloring material including an electron donating coloring compound and an electron accepting compound while controlling the heat. The present invention further relates to an information storage material comprising an information recording unit and a reversible display unit including the reversible thermosensitive recording medium. The present invention still further relates to a reversible thermosensitive recording label comprising the reversible thermosensitive recording medium and an adhesive layer. The present invention also relates to an image processing method of recording and/or erasing an image in the reversible thermosensitive recording medium and an image processing device comprising a device for recording an image in the reversible thermosensitive recording medium and/or a device for erasing an image therein.

2. Discussion of the Background

Thermosensitive recording media utilizing the coloring reaction between an electron donating coloring compound (hereinafter referred to as a coloring agent or a leuco dye) and an electron accepting compound (hereinafter referred to as a developing agent) are widely known. With the progress of office automation in business environments, these thermosensitive recording media are popularly used in a variety of applications such as output paper for facsimile apparatus, word processors, scientific measuring instruments, etc., and currently magnetic thermosensitive cards such as prepaid cards, reward cards, etc. The conventional thermosensitive recording media actually used are of an irreversible type in which a colored image cannot be discolorized (i.e., decolored). Namely, new information can be written in only non-recorded areas because images once recorded in the media cannot be erased. Consequently the information recording capacity of such conventional thermosensitive media is limited and it is necessary to reduce the amount of information to be recorded and to replace the conventional thermosensitive medium with a new card when the recording capacity thereof is used up. Therefore, considering the environmental problems such as the waste problem and deforestation which are now of great public interest, a need exists for rewritable reversible thermosensitive recording media to reduce the consumption amount of these conventional thermosensitive media.

A variety of reversible thermosensitive recording media have been proposed based on this need. Unexamined published Japanese Patent Applications Nos. (hereinafter referred to as JOP) 63-107584 and 4-78573 disclose reversible thermosensitive recording media of a high molecule type using a change in physical state between transparency and white turbidity. Reversible thermosensitive recording media of a dye type using a chemical reaction have been now disclosed. For example, JOP 60-193691 discloses a developing agent comprising gallic acid and fluoroglucinol, JOP 61-237684 discloses the use of a compound such as phenolphthalein or thymolphthalein as a developing agent, and JOPs 62-138556, 62-138568 and 62-140881 have disclosed a reversible thermosensitive recording layer containing a homogeneous mixture of a coloring agent, a developing agent and a carboxylic acid ester. Further, JOP 3-173684 discloses the use of an ascorbic acid derivative as a developing agent, and JOPs 2-188293 and 188294 have disclosed the use of a salt of a higher fatty amine and gallic acid or bis(hydroxyphenyl)acetic acid as a developing agent.

Further, JOPs 5-124360, 6-210954 and 10-95175 have disclosed reversible thermosensitive recording media including a recording layer comprising thermosensitive coloring material including a leuco dye serving as a coloring agent and a developing agent such as an organic phosphoric acid compound, an aliphatic carboxylate compound or a phenolic compound, each of which has a long chain aliphatic group. The thermosensitive coloring material can achieve a coloring state when heated to a first temperature and the color can be stably retained when rapidly cooled down to room temperature. Further, the colored image can be erased when heated to a second temperature which is lower than the first temperature and the decolorization state is stably retained when cooled down to room temperature. In addition, these coloring state and discolorization state can be repeatedly achieved.

However, these thermosensitive recording media are not satisfactory in terms of coloring sensitivity and image density and thus need improvement. Several countermeasures to improve coloring density and coloring sensitivity have been disclosed and one of the countermeasures is to provide an intermediate layer between a substrate and a reversible recording layer. The intermediate layer has a thermal insulation effect. JOP 2003-11514 discloses the use of an intermediate layer using a hollow silica, JOPs 6-340174 and 8-183254 have disclosed the use of an intermediate layer comprising fine hollow particles comprising a styrene-acrylic copolymer, and JOPs 7-228250 and 7-257036 have disclosed the use of an intermediate layer prepared using a latex including a hollow copolymer containing a carboxylic group. Further, Japanese Patent No. 3007899 discloses the use of an intermediate layer comprising polyvinylidene chloride hollow particles or porous aluminosilicate.

These countermeasures are developed to improve the efficiency of heat applied to the reversible thermosensitive recording layer by providing a layer comprising hollow particles between the substrate and the reversible thermosensitive recording layer. It is recognized that image density can be improved to a certain degree by such a layer. However, the hollow particles used in the countermeasures are limited to particles having a low hollow ratio or a large particle diameter due to the selection restriction on the materials and the methods. Therefore, hollow particles having a high hollow ratio and a small particle diameter have not been used. An intermediate layer comprising particles having a low hollow ratio (e.g., an intermediate layer using the styrene-acrylic fine hollow particles having a hollow ratio of about 50% described in JOPs 6-340174 and 8-183254) has little thermal insulation effect and cannot satisfactorily improve image density. On the other hand, in the case of an intermediate layer comprising hollow particles having a large diameter (e.g., the intermediate layer using vinylidene chloride hollow particles having a particle diameter of about 20 μm disclosed in Japanese Patent No. 3007899 and the intermediate layer using hollow silica particles having a particle diameter of about 40 μm disclosed in JOP 2003-11514), the particle diameter of the hollow particle is relatively large compared with the thickness of the intermediate layer and therefore the surface thereof has a concavo-convex surface. When a reversible thermosensitive recording layer is accumulated on a convex portion of the intermediate layer surface, the reversible thermosensitive layer may not be formed, which leads to a problem such as whiteout in a solid image. Therefore, these countermeasures are also not satisfactory with regard to improvement in image density.

When an erasure method using a heat roller is used for the reversible thermosensitive medium mentioned above, the erasure density has no practical problem. There is another erasure method using a thermal head. The erasure method using a thermal head has an advantage in that its energy consumption is small. However, the erasure density level is not practically satisfying in most cases for the erasure method using a thermal head. Therefore, there is a strong demand for improving the erasure density level by a thermal head erasure method. In addition, the erasable energy-range is not currently satisfactory for this thermal head erasure method. Therefore it is important to enlarge the erasable energy range. Because of these reasons, a need exists for a reversible thermosensitive medium which can exhibit an image having a high coloring image density and good uniformity without causing the whiteout problem, etc., and which has a wide erasable range such that a recorded image can be erased at a good erasure density level by a thermal head erasure method.

SUMMARY OF THE INVENTION

Accordingly, an object of the present invention is to provide a reversible thermosensitive recording medium, a reversible thermosensitive recording label and an information storage material, each of which can form an image having a high image density, less occurrence of whiteout and excellent uniformity upon application of heat. In addition, the reversible thermosensitive recording medium, the reversible thermosensitive recording label and the information storage material have a good heat insulation effect for an erasure method using a thermal head to erase a recorded image with a good erasure density and an enlarged erasable energy range width. Another object of the present invention is to provide an image processing method and an image processing device for recording and/or erasing an image in the reversible thermosensitive recording medium, the reversible thermosensitive recording label and the information storage material.

Briefly these objects and other objects of the present invention as hereinafter will become more readily apparent can be attained by a reversible thermosensitive recording medium including a substrate, a recording layer and an intermediate layer disposed therebetween. The recording layer is configured to reversibly record and erase an image therein. The recording layer contains a first binder resin and a reversible thermosensitive coloring composition. The reversible thermosensitive coloring composition includes an electron donating coloring compound and an electron accepting compound. The electron accepting compound contains a phenol compound having a long chain aliphatic group having at least 10 carbon atoms and an active hydrogen containing group capable of forming a hydrogen bonding. The intermediate layer includes a second binder resin and a content of hollow particles having a hollow ratio not less than 70%, a maximum particle diameter (D100) of from 5.0 to 10.0 μm and the ratio (D100/D50) of the maximum particle diameter thereof (D100) to a 50% cumulative particle diameter (D50) of from 2.0 to 3.0. Further, the recording layer achieves and maintains a colored state when heated to a temperature not lower than a melting point thereof and then cooled down. Furthermore the recording layer achieves and maintains a discolorization state when heated to a temperature lower than the melting point and then cooled down. In addition, the recording layer has an erasable energy range width of at least 0.1 mJ/dot when achieving the discolorization state with a thermal head.

It is preferred that the hollow particle included in the intermediate layer of the reversible thermosensitive recording medium mentioned above contains an acrylonitrile copolymer and/or a methacrylonitrile copolymer.

It is still further preferred that the hollow particle included in the intermediate layer of the reversible thermosensitive recording medium mentioned above contains a copolymer comprising a unit obtained from a monomer represented by the following chemical formula (1):

[Chemical formula 1]

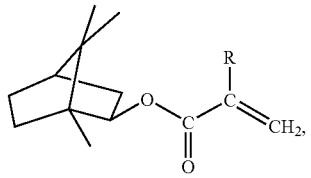

wherein R represents a hydrogen atom or a methyl group.

It is still further preferred that the second binder resin in the reversible thermosensitive recording medium mentioned above includes a resin selected from hydrophobic resins, ultraviolet curing resins and water soluble resins.

It is still further preferred that, in the reversible thermosensitive recording medium mentioned above, the weight ratio of the second binder resin to the content of hollow particles is 1/1/ to 2/1.

It is still further preferred that, in the reversible thermosensitive recording medium mentioned above, the electron accepting compound is a compound represented by the following chemical formula (2):

[Chemical formula 2]

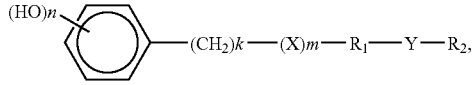

wherein k represents 0 or an integer of from 1 to 2; m represents 0 or 1; and n represents an integer of from 1 to 3, X and Y independently represent a divalent group having a nitrogen atom or an oxygen atom, R1 represents an aliphatic hydrocarbon group having at least two carbon atoms which can optionally have a substitute group and R2 represents an aliphatic hydrocarbon group having at least one carbon atom.

It is still further preferred that the recording layer of the reversible thermosensitive recording medium mentioned above further comprises an achromatic promoter.

It is still further preferred that the reversible thermosensitive recording medium mentioned above further includes a protective layer which is disposed overlying the recording layer and which includes a cross-linked resin.

As another aspect of the present invention, an information storage device is provided which includes an information storage unit and a reversible display unit. The display unit contains a reversible thermosensitive recording layer. The thermosensitive recording layer contains a binder resin and a reversible thermosensitive coloring composition. The reversible thermosensitive coloring composition contains an electron donating coloring compound and an electron accepting compound. The electron accepting compound contains a phenol compound including a long chain aliphatic group having at least 10 carbon atoms and an active hydrogen containing group capable of forming a hydrogen bonding.

It is preferred that the information storage unit in the information storage material mentioned above is a card, a disc, a disc cartridge or a cassette tape.

It is still further preferred that the reversible display unit in the information storage material mentioned above further includes a substrate configured to bear the reversible thermosensitive recording layer and an adhesive layer. The adhesive layer is disposed on a side of the substrate opposite to the side that bears the reversible thermosensitive recording layer.

As another aspect of the present invention, a reversible thermosensitive recording label is provided which contains the reversible thermosensitive recording medium mentioned above and an adhesive layer disposed on a side of the substrate opposite to the side that bears the reversible thermosensitive recording layer.

As another aspect of the present invention, an image processing method is provided which includes the step of erasing a recorded image in the recording layer of the reversible thermosensitive recording medium mentioned above by heating the recording layer to a temperature lower than the melting point thereof.

It is preferred that, in the image processing method mentioned above, the image erasing is performed using a thermal head or a ceramic heater.

It is still further preferred that the image processing method mentioned above further includes the step of recording an image in the recording layer by heating the recording layer to a temperature not lower than a melting point thereof.

It is still further preferred that, in the image processing method mentioned above, the image recording is performed using a thermal head.

As another aspect of the present invention, an image processing method is provided which includes the step of recording an image in the recording layer of the reversible thermosensitive recording medium mentioned above by heating the recording layer to a temperature not lower than the melting point thereof.

It is preferred that, in the image processing method immediately mentioned above, the image recording is performed using a thermal head.

As another aspect of the present invention, an image processing device is provided which includes an image erasing device configured to erase a recorded image in the recording layer of the reversible thermosensitive recording medium mentioned above.

It is preferred that, in the image processing device mentioned above, the image erasing is performed using a thermal head or a ceramic heater.

It is still further preferred that the image processing device mentioned above further includes an image recording device configured to record an image in the recording layer of the reversible thermosensitive recording medium mentioned above.

It is still further preferred that, in the image processing device mentioned above, the image recording is performed using a thermal head.

As another aspect of the present invention, an image processing device is provided which includes an image recording device configured to record an image in the recording layer of the reversible thermosensitive recording medium mentioned above.

It is preferred that, in the image processing device, the image recording is performed using a thermal head.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The inventors of the present invention have intensively studied hollow particles and binding agents used in a heat insulative intermediate layer which is provided between a substrate and a reversible thermosensitive recording layer forming a reversible thermosensitive recording medium, and have found that each hollow particle has a suitable binding agent. Namely, it is preferred to select a suitable binding agent for a hollow particle having a particular particle diameter and a particular hollow ratio considering purposes to be fulfilled. In addition, the inventors of the present invention have also intensively studied electron accepting compounds and controlling agents for use in the reversible thermosensitive recording layer and have found that the electron accepting compounds and the controlling agents can improve coloring characteristics and discolorization characteristics of the reversible thermosensitive recording layer.

The present invention will be described below in detail with reference to several embodiments and accompanying drawings.

When an erasure method using a thermal head is adopted, the present invention can greatly improve the erasure characteristics. It is especially important to enlarge an erasable energy range width in which an image is erased (i.e., in a discolorization state).

Figure 6:
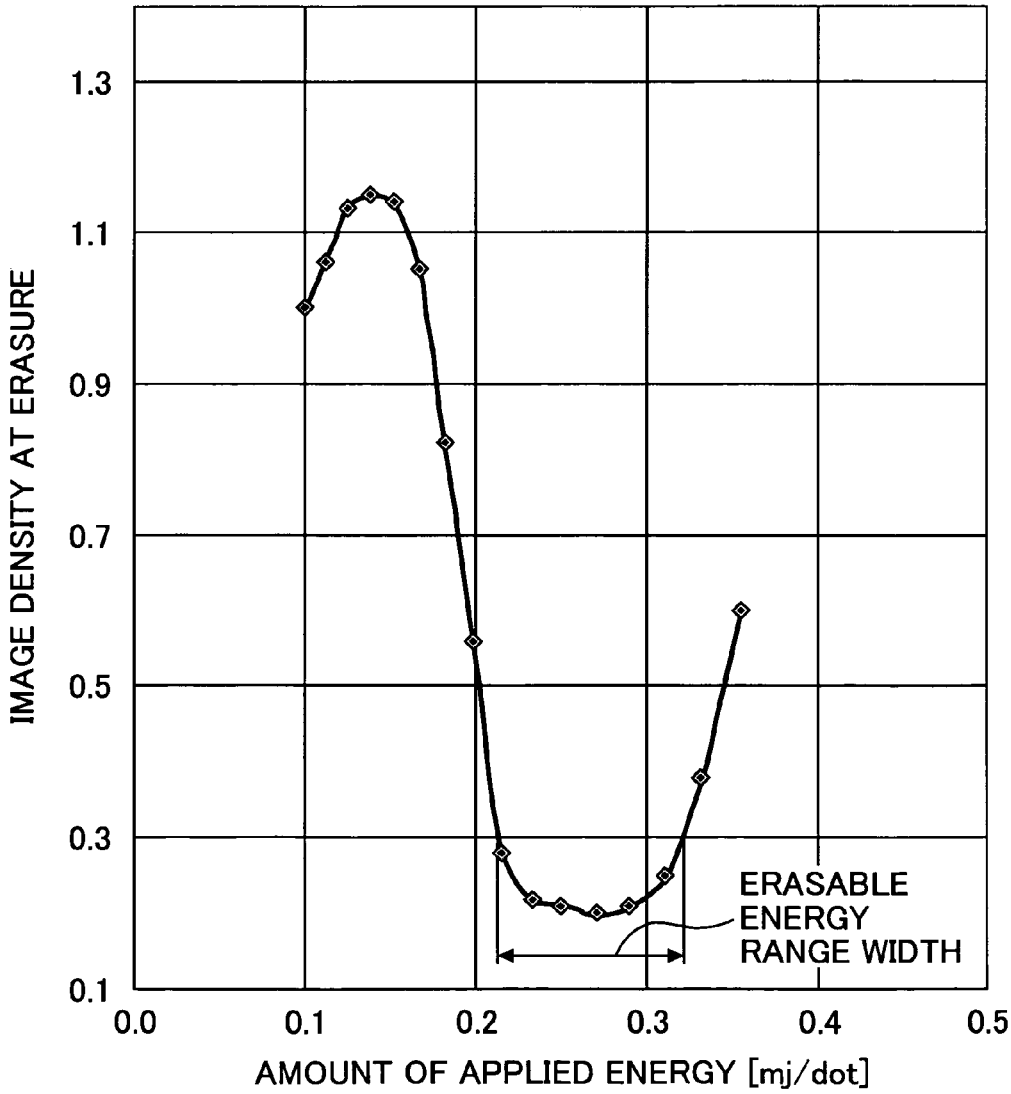
FIG. 6 is a graph illustrating the relationship between the image density (i.e., erasure density) and the erasure energy obtained in a thermal head erasure system used in the image processing device of the present invention.

FIG. 6 is a graph illustrating the relationship between the amount of energy applied and the image density (i.e., erasure density) for a thermal head erasure method. As seen in the graph, there is a portion where the image density is convex downward against the amount of energy applied. The erasable energy range width is the bottom of the graph as indicated by the line having arrows at both ends. A discolorization state (i.e., the image density in the erasable energy range width) is achieved in a recording layer when the amount of energy applied thereto is less than that which is enough to melt the recording layer. A colored state is achieved in a recording layer when the amount of energy applied is not less than that enough to melt the recording layer.

It is obvious that the lower the image density is, the better the erasure characteristic is. When the erasure density is the same, it is preferred that an erasable energy range width in which an image can be erased is wide. Namely, even when the same amount of energy is applied to a reversible thermosensitive recording medium, the temperature thereof actually varies albeit only slightly because the ambient temperature is not always the same. Therefore, there is a problem in that the erasure characteristics become unstable when the erasable energy range width is narrow because the image density is greatly affected by fluctuation of the ambient temperature. In contrast, the erasure characteristics are stable and do not greatly vary when the erasable energy range width is wide because the image density is not greatly affected by fluctuation of the ambient temperature. Therefore, it is important to widen the erasable energy range width when a thermal head erasure method is adopted.

In the present invention, when a thermal head is used for erasure, an image having an image density not greater than 0.3 is defined as an image in the erasure state, i.e., in the discolorization state (as shown in FIG. 6). When an image has an image density greater than 0.3, the image before erasure can be still recognized with a naked eye, which is not sufficient as erasure level. Thus, the erasable energy range width is the energy area width in which the image density is not greater than 0.3 at erasure.

In the present invention, it is preferred that the erasable energy range width is not narrower than 0.1 mJ/dot. When an image is erased by a thermal head method in a low temperature environment or a high temperature environment while the erasable energy range width is too small, the image density obtained becomes high and the erasure characteristics thus deteriorate. Although it is preferred that the erasable energy range width is wide, 0.5 mJ/dot and below is preferred in light of practicality.

It is found in the present invention that it is possible to widen the erasable energy range width for a thermal head method by providing an intermediate layer between a substrate and a reversible thermosensitive recording layer. The intermediate layer comprises hollow particles having a hollow ratio not less than 70% and a maximum particle diameter (D100) of from 5.0 to 10.0 μm. In addition, the ratio (D100/D50) is from 2.0 to 3.0, wherein D50 represents a 50% cumulative particle diameter. The 50% cumulative particle diameter represents the particle diameter obtained when the number of particles reaches half of the total number thereof counting from the smallest particle and is referred to as D50 in the particle size distribution.

It is preferred in the present invention that the maximum particle diameter of hollow particles is from 5 to 10 μm. When the maximum particle diameter is too large, a reversible thermosensitive recording layer is not properly formed at the portion where such a large particle exists in the intermediate layer. If this is the case, a solid image tends not to be properly printed due to occurrence of whiteout. In contrast, when the maximum particle diameter is too small, it is difficult for hollow particles to have a hollow ratio not less than 70%. In this case, the sensitivity deteriorates. Therefore, the maximum particle diameter of hollow particles is preferred to be from 5 to 10 μm. When the hollow ratio is not less than 60%, it is possible to improve colorization density. However, a reversible thermosensitive recording medium has an image erasing process. In addition, when an image is erased by a thermal head, the amount of energy used for erasing the image is extremely small compared with that required when erased by a heat roller. Thus it is necessary to utilize the energy applied more efficiently in a thermal head method. Consequently, to secure an erasure image density and an enlargement of the erasable energy range width for a thermal head method, hollow particles for use in an intermediate layer are necessary to have a hollow ratio not less than 70%.

It is preferred in the present invention that the ratio (D100/D50) of the maximum particle diameter of hollow particles to the 50% cumulative particle diameter (D50) is 2.0 to 3.0. When the ratio (D100/D50) is too large, the particle size distribution is broad, meaning that the ratio of fine particles having a particle diameter not greater than 1 μm is large. In this case, such hollow particles are not uniformly present in the intermediate layer containing the hollow particles, resulting in deterioration of the sensitivity. When the ratio (D100/D50) is too small, the particle size distribution thereof is extremely sharp. Such hollow particles are difficult to manufacture in terms of composition conditions. Therefore, the ratio (D100/D50) of the maximum particle diameter (D100) of hollow particles to the 50% cumulative particle diameter (D50) is preferably from 2.0 to 3.0.

It is preferred in the present invention that the ratio of hollow particles having a diameter not greater than 2 μm is from 5 to 10%. When the ratio is too large, the ratio of fine hollow particles having a particle diameter not greater than 1 μm is large. Such hollow particles are not uniformly present in the intermediate layer containing the hollow particles, resulting in deterioration of colorization sensitivity. When the ratio is too small, the particle size distribution thereof is extremely sharp. Such hollow particles are difficult to manufacture in terms of composition conditions. Therefore, the ratio of hollow particles having a diameter not greater than 2 μm is preferably from 5 to 10%.

The hollow particles in the present invention are characterized in that the hollow particles have a hollow ratio not less than 70% and a maximum particle diameter (D100) of from 5.0 to 10.0 μm and the ratio (D100/D50) of the maximum particle diameter (D100) to a 50% cumulative particle diameter (D50) is from 2.0 to 3.0. The hollow particles satisfying the conditions mentioned above have not been used for a reversible thermosensitive recording material so far. Conventionally, the hollow particles used in a reversible thermosensitive recording material are prepared by a method in which a volatile material contained in a thermoplastic polymer is evaporated and foamed to obtain hollow particles having a hollow ratio not less than 60%. The hollow particles obtained by such a method have a particle diameter not less than 20 μm. On the other hand, to obtain small hollow particles, for example, hollow particles having a particle diameter not greater than 1 μm can be obtained by a method in which water, etc., contained in the hollow particles is discharged through the use of seed polymerization. However, such hollow particles cannot have a hollow ratio greater than 50%. In the present invention, shell materials, polymerization methods and volatile internal capsule agents were studied to obtain hollow particles satisfying the following conditions: a hollow ratio not less than 70%; a maximum particle diameter (D100) of from 5.0 to 10.0 μm; and the ratio (D100/D50) of the maximum particle diameter (D100) to a 50% cumulative particle diameter (D50) of from 2.0 to 3.0. Further, as a result of repeated application of the hollow particles to reversible thermosensitive recording materials and the following observation of the performance thereof, good reversible thermosensitive recording materials were made.

In the present invention, the glass transition temperature (hereinafter referred to as Tg) of a hollow particle is preferably from 95 to 150° C. and more preferably from 95 to 120° C. When an intermediate layer comprising such hollow particles having too low a Tg is used for printing with a thermal head, the intermediate layer fuses, adheres and sticks to a thermosensitive coloring layer, resulting in occurrence of poor printing. In contrast, when an intermediate layer comprising such hollow particles having too high a Tg is used for printing with a thermal head, the intermediate layer is inflexible (i.e., deficient in flexibility), and thus the coherent property between the medium and the head deteriorates, resulting in deterioration of sensitivity. Therefore, Tg of the hollow particles is preferably from 95 to 150° C.

As mentioned above, heat insulation properties and head coherent properties of a thermosensitive recording medium are improved by using the following hollow particles for an intermediate layer in the thermosensitive recording medium: a hollow ratio is not less than 70%; a maximum particle diameter (D100) is not greater than 10.0 μm, and preferably from 5.0 to 10.0 μm; the ratio (D100/D50) is not greater than 3.0, and preferably from 2.0 to 3.0, wherein D50 represents a 50% cumulative particle diameter; the hollow particle content contains hollow particles having a particle diameter not greater than 2 μm in an amount of not greater than 10%, and preferably from 5 to 10%; and Tg is not lower than 95° C., and preferably from 95 to 150° C. In such a thermosensitive recording medium, heat of a thermal head is efficiently conveyed to the surface of the thermosensitive recording medium. Therefore, the thermosensitive recording medium can improve its sensitivity. In addition, the surface of the thermosensitive recording medium is maintained uniform so that whiteout can be prevented, resulting in improvement in uniformity of a printed image.

The particle diameter mentioned in the present invention is measured by a laser diffraction particle size distribution measuring device (LA-900 manufactured by Horiba, Ltd.). The median particle diameter represents a 50% cumulative particle diameter and is specified as D50. The maximum particle diameter represents the maximum particle diameter in the distribution and is specified as D100. The hollow ratio of this plastic hollow fine particle having a sphere form is the ratio of the outer particle diameter thereof to the inner particle diameter thereof and is represented by the following relationship:

Hollow ratio (%)=(Inner particle diameter of hollow particle/Outer particle diameter of hollow particle)×100

The characters Tg in the present invention represent the glass transition temperature of the resin composition included in a hollow particle. This Tg is measured for a solid material made of the same resin as that in the hollow particle by using a typical method such as DSC, DTA and TMA.

Since the hollow particle in the present invention serves as a heat insulation material and has a good elasticity, heat energy from a thermal head is efficiently used, resulting in improvement of colorization sensitivity. In terms of the sensitivity, it is preferred to use a hollow particle having a hollow ratio not less than 70%, preferably of from 75 to 98% and more preferably of from 85 to 95%. When the hollow ratio is too low, the hollow particle is not so effective as mentioned above. When the hollow ratio is too high, the hollow particle is weak in strength because the thickness thereof is thin.

Various kinds of methods of manufacturing hollow particles have been disclosed. The hollow particles of the present invention are typically prepared by a method in which a polymer comprising a volatile material as the core material of the polymer and a thermoplastic polymer forming the outer layer of the polymer is evaporated and foamed. WO99/43758, WO99/46320 and JOP 2000-24488 have disclosed specific methods of manufacturing such hollow particles. In this method, there is a requirement that a shell material has a low transparency to obtain a hollow particle having a hollow ratio not less than 70% at foaming with heat. The conventional polymer containing vinylidene chloride has a low transparency but causes an environmental problem. Therefore, the inventors of the present invention use a cross-linked vinyl polymer instead of vinylidene chloride as a shell material having a low transparency to obtain a hollow particle having a hollow ratio not less than 70%.

Specific examples of vinyl polymers for use in the present invention include monomers including a carboxylic acid therein such as acrylic esters, ethylene, propylene, vinyl acetates, styrenes, acrylic nitrites, methacrylic nitrites, acrylic acids, methacrylic acids, succinic acid and itaconic acid, metals salts of a carboxylic acid such as magnesium acrylates, calcium acrylates, zinc acrylates, magnesium methacrylates, calcium methacrylate and zinc methacrylate, compounds including a group reacting with a carboxylic acid therein such as N-methylol acrylic amides, N-methylol methacrylic amides, glycidyl acrylates, glycidyl methacrylate, 2-hydroxy ethyl (meth)acrylate, 2-hydroxy propyl (meth) acrylate, 2-hydroxy butyl (meth)acrylate, 2-hydroxy-3-phenoxy propyl acrylate, N,N-dimethyl aminoethyl (meth)acrylate, N,N-dimethylaminopropyl methacrylates, magnesium monoacrylates, zinc monoacrylates, etc, acrylic amides, methacrylic amides, N,N-dimethylacrylic amides, N,N-dimethyl methacrylic amides, methyl methacrylates, t-butyl methacrylates, isobornyl (meth)acrylates, cyclohexyl methacrylates, benzyl methacrylate, N-vinylpyrrolidone, styrenes, N-phenyl maleimides, N-naphthyl maleimides, N-cyclohexyl maleimides and methyl maleimides.

When hollow particles have a high hollow ratio, the thickness of the shell thereof is thin. When the shell is thin, the strength thereof against pressure, etc., is weak and the shell is easy to break. However, when a shell is hardened simply to impart strength thereto, the shell tends to be breakable against bending. Therefore, it is necessary to balance hardness and flexibility of a shell material. Specific preferred examples of such shell materials include acrylic nitrile and methacrylic nitrile. The hollow particles having the particle diameter and the hollow ratio mentioned above can be also manufactured using other shell materials, polymerization methods, and volatile inner capsule agents.

It is possible for the hollow particle for use in the present invention to form a cross linking structure. Specific materials to form a cross linking structure (i.e., a cross-linking agent) include copolymers formed by the vinyl monomers mentioned above and monomers including at least two functional groups therein. Vinyl monomers having at least two vinyl groups per molecule or divinyl benzene are preferred. Known cross-linking monomers can be used. Specific examples of such cross-linking monomers are as follows:

Ethylene glycol di(meth)acrylate, propylene glycol di(meth)acrylate, diethylene glycol di(meth)acrylate, 1,4-butane diol di (meth) acrylate, 1,6-hexane diol di (meth) acrylate, trimethylol propane tri(meth)acrylate, glycerine di(meth)acrylate, triethylene glycol di(meth)acrylate, PEG#200 di(meth)acrylate, PEG#400 di(meth)acrylate, PEG#600 di(meth)acrylate, 1,3-butane diol di(meth)acrylate, neopenthyl glycol di(meth)acrylate, 1,10-decane diol di(meth)acrylate, pentaerythritol tri(meth)acrylate, pentaerythritol tetra(meth)acrylate, pentaerythritol tetra(meth) acrylate, pentaerythritol hexa(meth)acrylate 3-acryloyloxy glycerine monoacrylate, dimethylol tricyclodecane di(meth) acrylate, triaryl formal tri(meth)acrylate, polyethylene glycol dimethacrylate, polypropylene glycol dimethacrylate, 2,2'-bis(4-acryloxy diethoxyphenyl)propane, trimethylol propane trimethacrylate, phthalic acid diallyl, divinyl benzene.

Cross-linking monomers not including a halogen atom such as chlorine atom are used. In addition, the hollow particle formed needs to have a sharp particle size distribution to keep the maximum particle diameter 10 μm and under. The copolymers including an acrylic monomer represented by the following chemical formula (1) have a characteristic that their particle size distribution is sharp and thus has an excellent effect.

[Chemical formula 1]

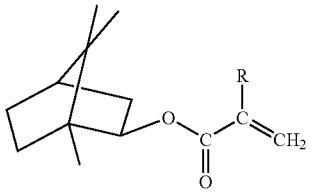

The end of cross bonding of norbornane in the left cycle in the chemical formula above is a hydrogen atom but a methyl group is also allowed. The content of the cross-linking agent for use in the present invention is from 0.1 to 10% in the monomer.

Microcapsules can be manufactured by known methods of manufacturing foaming microcapsules. Namely, gels containing colloidal silica are used as a dispersant for an aqueous system. Water soluble high molecular compounds are used as an assistant dispersant.

Specific examples of such water soluble high molecular compounds include amphoteric or cationic water soluble high molecular compounds such as condensation products of diethanol amine adipic acid, polyethylene imines and polyvinyl pyrrolidone containing polymers.

Since a large amount of water soluble monomers is used in the present invention, inorganic metal salts are used. Specific examples of such water soluble metal salts include compounds soluble in water in the neutral or acid range such as sodium chloride, magnesium chloride, and sulfates of soda.

The amount used is in the range of from saturation amount to saturation amount minus 5% to the aqueous mixture. The mixture mentioned above is adjusted to have a pH of from 3 to 5 and is used as an aqueous system.

An oil phase is uniformly mixed for use. The above-mentioned monomer mixtures having a radically reactive unsaturated double link, a solvent mixture having a boiling point suitable for synthesis, and a radical initiator mixture are used as an oil phase. An organic solvent having a boiling point not higher than the temperature suitable for synthesis is used as the solvent. Any organic solvent which is insoluble to the outer layer polymer and has a high efficient foaming ratio can be used. However, the organic solvent is used under a high temperature. Therefore, solvents of hydrocarbon type having a boiling point of from 50 to 200° C. are preferred. N-hexane, isohexane, n-heptane, n-octane, isooctane, n-decane, isodecane and other distilled petroleum components are used where appropriate. When a solvent having a relatively low boiling point is used, the temperature at which foaming starts tends to lower.

At least two kinds of radical initiators are mixed for use. It is preferred that at least two catalysts which have a temperature difference not smaller than 20° C. for 10 hour half life period are used to eliminate remaining acrylic nitrile monomers. Peroxyacid type or azobis type catalysts can be used and it is preferred that such a catalyst has a 10 hour half-life period of from 0 to 130° C. and preferably from 20 to 100° C.

Specific examples of such radical initiators include diisopropyl peroxycarbonate, di-octyl peroxycarbonate, t-butyl peroxy laurate, lauroyl peroxide, di-octanoyl peroxide, benzoil peroxide, azobis isobutyronitrile, azobis(2,4-di-methyl valeronitrile), 1,1 azobis(cyclohexane-1-carbonitrile) and dimethyl 2,2-azobis(2-methylpropionate). A combinational use of azobis isobutylonitrile and 1,1 azobis(cyclohexane-1-carbonitrile) or azobis(2,4-di-methylvaleronitrile) and 1,1 azobis(cyclohexane-1-carbonitrile) is preferred.

In the present invention, hollow particles and a binder resin such as hydrophobic resins, ultraviolet curing resins and water soluble resins are used to improve sensitivity of the particle mentioned above. When the weight ratio of such a binder resin to the hollow particle is from 1/1 to 3/1, and preferably from 1/1 to 2/1, it is found that the sensitivity is greatly improved. This is thought to be because voids between the hollow particles in an intermediate layer are filled by such a binder resin, which leads to further improvement of the smoothness of the surface of the intermediate layer. When the content of such a binder resin is too small, coloring density deteriorates because the void between the hollow particles still remains. When the content of such a binder resin is too large, the heat insulation property of the intermediate layer deteriorates because the content ratio of the hollow particle in the intermediate layer lowers. Therefore the sensitivity deteriorates.

Specific examples of hydrophobic resins for use in the intermediate layer include latexes including styrene/butadiene copolymers and butadiene/acrylic ester copolymers and emulsions of vinyl chloride, vinyl chloride/acrylic acid copolymers, styrene/acrylic ester copolymers, acrylic ester resins, polyurethane resins, etc. Specific examples of the ultraviolet curing resins used in an intermediate layer include urethane acrylate containing water soluble ultraviolet curing resins, epoxy acrylate containing water soluble ultraviolet curing resins, alkoxy acrylate containing resins, polyurethane acrylate containing ultraviolet curing emulsions, acrylic monomers, urethane acrylic oligomers, ether containing urethane acrylate oligomers, ester containing urethane acrylate oligomers and polyester acrylate oligomers. Further, specific examples of water soluble resins used in the intermediate layer include modified polyvinyl alcohols such as complete saponified polyvinyl alcohols, carboxyl modified polyvinyl alcohols, partially saponified polyvinyl alcohols, sulfonate modified polyvinyl alcohols, silyl modified polyvinyl alcohols, acetoacetyl modified polyvinyl alcohol, di-acetone modified polyvinyl alcohols.

In the present invention, known water soluble high molecules can be used in combination as long as such known water soluble high molecules do not affect the sensitivity. Specific examples of known water soluble high molecules and aqueous high molecule emulsions as binders include amylums and their derivatives, cellulose derivatives such as methoxy cellulose, hydroxylethyl cellulose, carboxy methyl cellulose, methyl cellulose and ethyl cellulose, polyacrylic acid soda, polyvinyl pyrrolidone, acrylic amide/acrylic acid ester copolymers, alkali salts of styrene/anhydrous maleic acid, alkali salts of isobutylene/anhydrous maleic acid copolymers, polyacrylic amides, alginic acid of soda, gelatine and casein. Specific water soluble emulsions include, emulsions of styrene/butadiene copolymers, latex including styrene/butadiene/acrylic ester copolymers, vinyl acetate, vinyl acetate/acrylic acid copolymers, styrene/acrylic ester copolymers, acrylic ester resins and polyurethane resins.

It is also possible to use alkaline viscosity improver to the intermediate layer mentioned above to improve head matching property. Alkali viscosity improver means binders which improve viscosity thereof under alkaline state. Specific examples of such alkaline viscosity improvers include an emulsion latex mainly including styrene/butadiene copolymers. In the present invention, it is possible to singly use such an alkaline viscosity improver. However, to make the binder composition stably present as dispersing particles, it is preferred to use, for example, a carboxylized latex which includes a copolymer of unsaturated carboxylic acid. Such a carboxylized latex improves its viscosity when pH is increased. This is because polymers having a plurality of carboxyl groups in the surface of a particle of the carboxylized latex dissolve in water. Consequently, the viscosity of the binder mentioned above further improves. The intermediate layer of the present invention has the structure mentioned above so that dispersion stability of plastic fine hollow particles increases. Therefore, it is unnecessary to add a typical viscosity improver such as sodium montmorillonite and modified polyacrylic acid. In addition, an alkaline viscosity improver strongly binds hollow particles. Therefore, the thermal head matching property is greatly improved when an alkaline viscosity improver is used compared with the case of the above mentioned viscosity improver. This alkaline viscosity improver is present in an amount of from 1 to 80 parts, and preferably from 5 to 50 parts, to 100 parts of the hollow particle. In addition, the binder mentioned above is preferably a styrene-butadiene copolymer but is not limited thereto. Any binder which can improve viscosity in an alkaline state can be used. A pH adjustment agent is necessary to keep an intermediate layer liquid in an alkaline state. Specific examples of such pH adjustment agents include $NH_3$ water but are not limited thereto. Any pH adjustment agent can be used as long as such agents do not extremely block coloring. Other than plastic fine hollow particles and alkaline viscosity improvers, assistant additive compositions such as fillers, thermomelting materials and surface active agents which are typically used for this type of thermosensitive recording medium can be added to an intermediate layer if appropriate. Various kinds of the fillers and thermomelting materials are specified in connection with reversible thermosensitive recording layer compositions later.

Other than the hollow particles and the binders mentioned above, assistant additive compositions such as fillers, thermofusing materials and surface active agents which are typically used for this type of thermosensitive recording medium can be added to the intermediate layer where appropriate. It is preferred that viscosity of 20% water dispersion liquid of hollow particle at a liquid temperature of 20° C. is not greater than 200 mPa·s to uniformly apply these intermediate layer compositions to a substrate at a high speed. When the viscosity above is too large, the viscosity of the application liquid prepared as described increases, resulting in non-uniform application. To make the surface of the intermediate layer formed as mentioned on a substrate more even after the intermediate layer is formed, the intermediate layer can be subjected to a calendar treatment.

In the present invention, the electron accepting compound represented by the chemical formula (2) is preferably used for the reversible thermosensitive recording layer in terms of coloring density and erasure properties.

[Chemical formula 2]

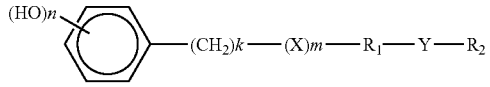

(In the formula, k represents 0 or an integer of from 1 to 2, m represents 0 or 1; and n represents an integer of from 1 to 3. X and Y independently represent a divalent group having a nitrogen atom or an oxygen atom, and $R_1$ represents an aliphatic hydrocarbon group having at least two carbon atoms which can optionally have a substitute group and $R_2$ represents an aliphatic hydrocarbon group having at least one carbon atom.)

In the chemical formula (2) illustrated above, the aliphatic hydrocarbon group can be a straight type or branch type and have an unsaturated link therein. The substitute group attached to the hydrocarbon group is a hydroxyl group, a halogen atom, an alkoxy group, etc. When the total number of carbon atoms in $R_1$ and $R_2$ is less than 8, stability of coloring and discolorization properties deteriorate. Therefore, it is preferred that the total number is 8 and above, and more preferably 11 and above.

Specific preferred examples of $R_1$ are as follows:

[Chemical formulae 3]

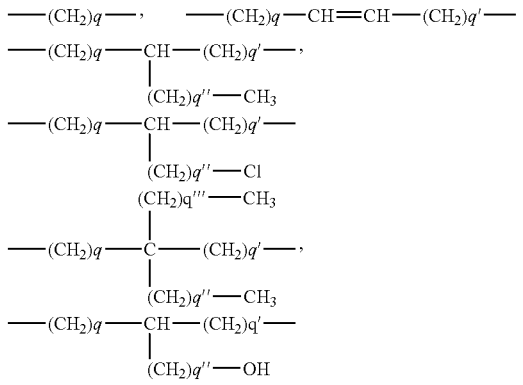

Among these, —$(CH_2)$q— is particularly preferred. Characters q, q', q" and q"' in the formulae independently represent integers satisfying the relationship of the number of carbon atoms in $R_1$ and $R_2$ mentioned above.

Specific preferred examples of $R_2$ are as follows:

[Chemical formulae 4]

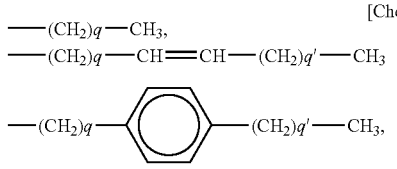

-continued

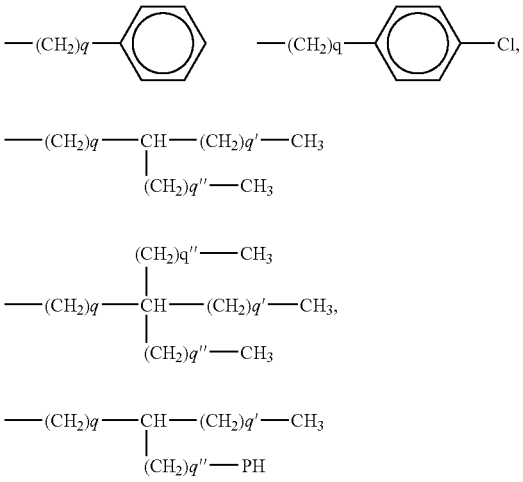

Among these, —$(CH_2)q—CH_3$ is particularly preferred. Characters q, q', q" and q'" in the formula represent the same as above.

X and Y independently represent a divalent group having a nitrogen atom or an oxygen atom and preferably a divalent group having at least one group represented by the following chemical formulae (5) illustrated below:

[Chemical formulae 5]

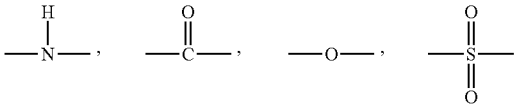

Specific examples of these are as follows:

[Chemical formulae 6]

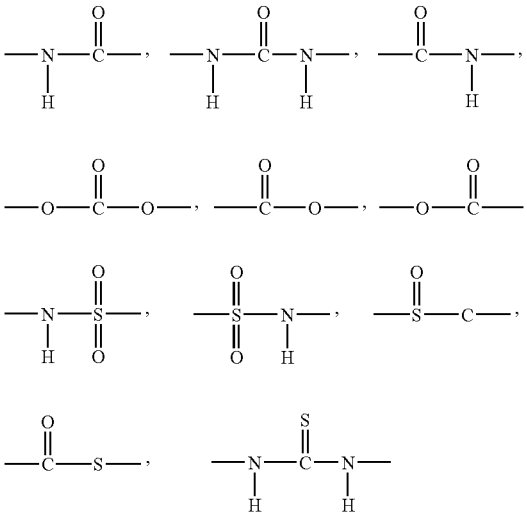

-continued

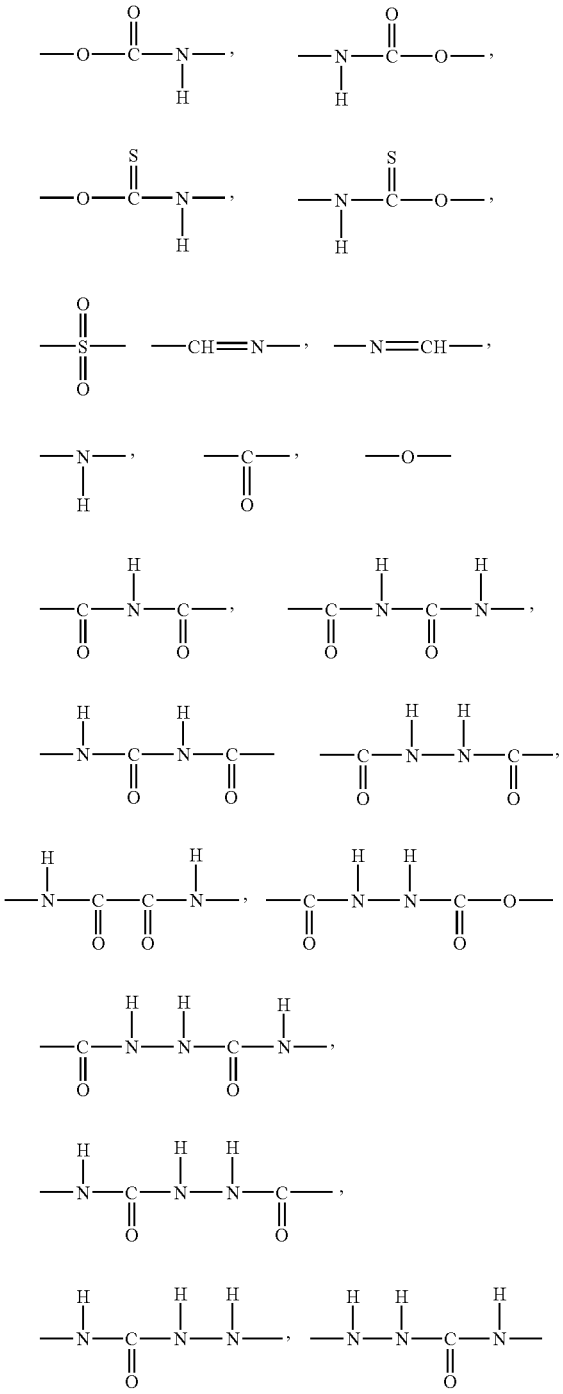

Among these, particularly preferred groups are as follows:

[Chemical formulae 7]

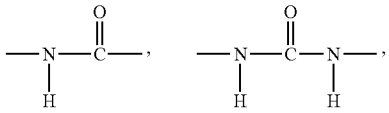

-continued

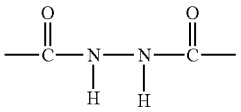

Further, specific examples of phenol compounds are as follows but not limited thereto:

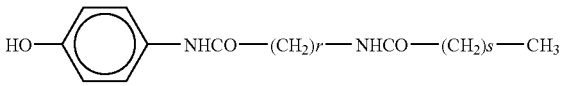

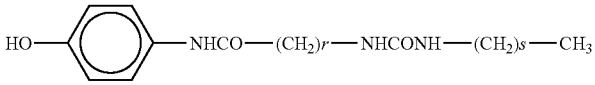

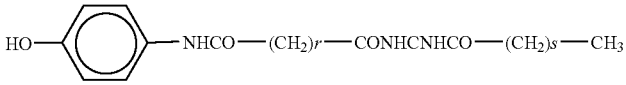

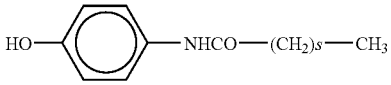

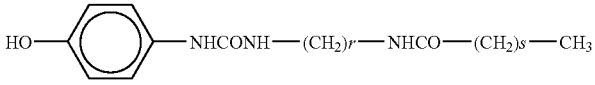

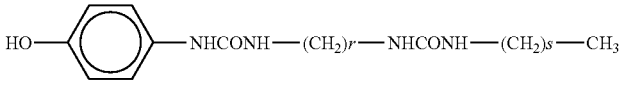

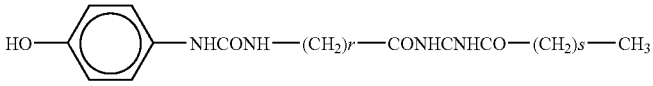

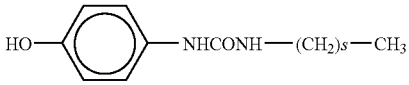

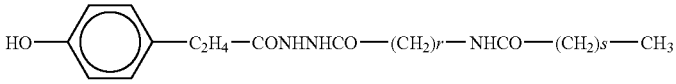

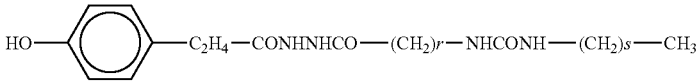

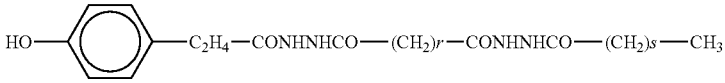

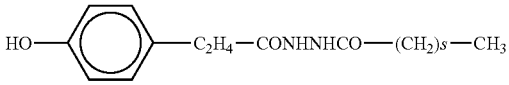

(wherein, r represents an integer of 2 and above and s represents an integer of 1 and above.)

In the present invention, control agents for use in the reversible thermosensitive recording layer are preferably compounds including an amide group, a urethane group, a urea group, a ketone group and/or an diacylhydrazido group therein. Among these, compounds having an amide group, a secondary amide group and a urethane group are particularly preferred and specific examples of these include:

[Chemical formulae 8]

[Chemical formulae 9]
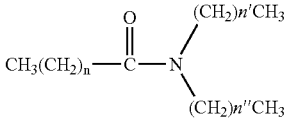
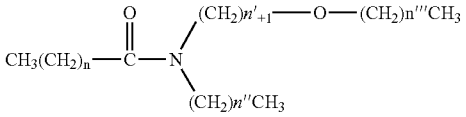
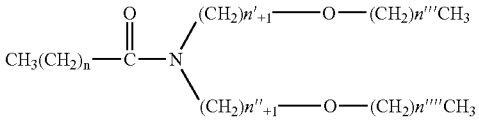
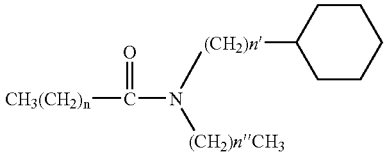
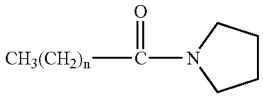
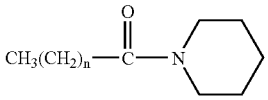
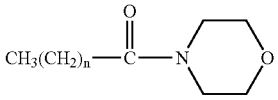
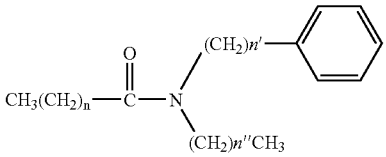
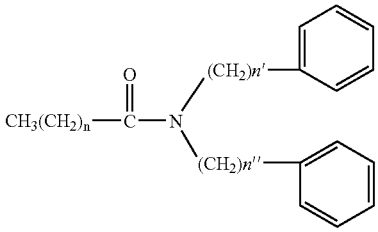
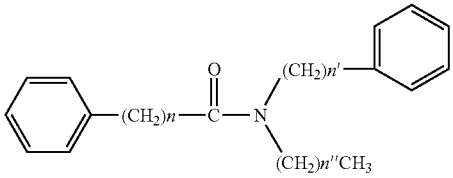
[Chemical formulae 10]
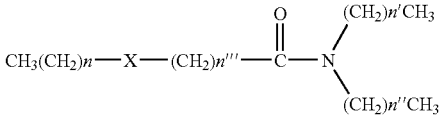
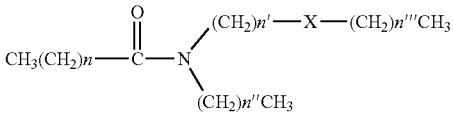
-continued
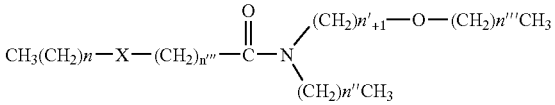
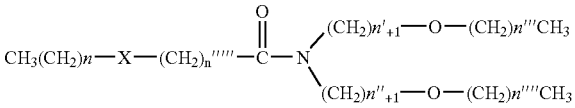
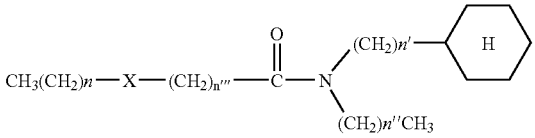
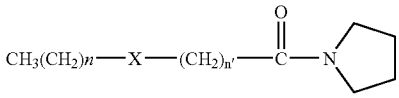
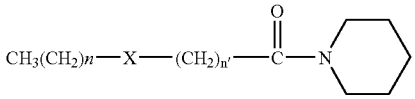
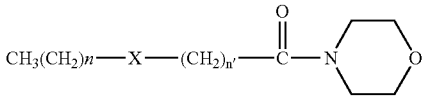
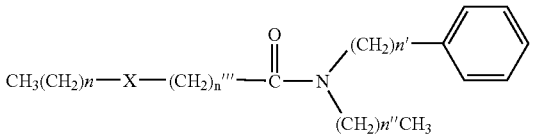
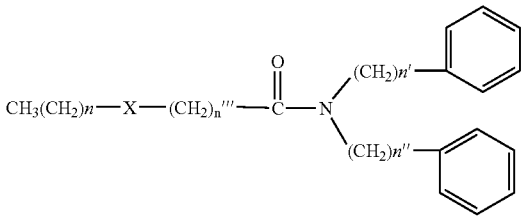
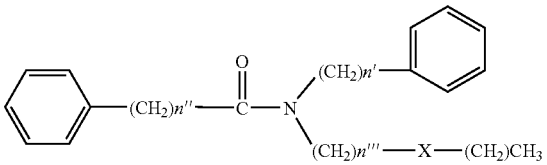
[Chemical formulae 11]
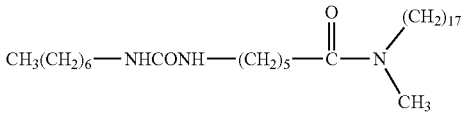
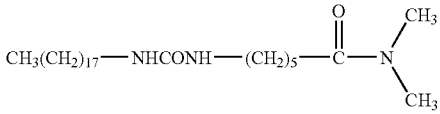
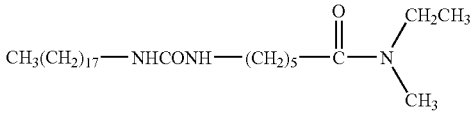
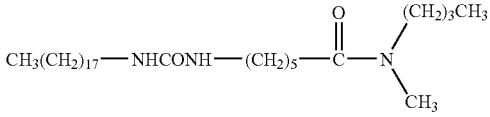

-continued

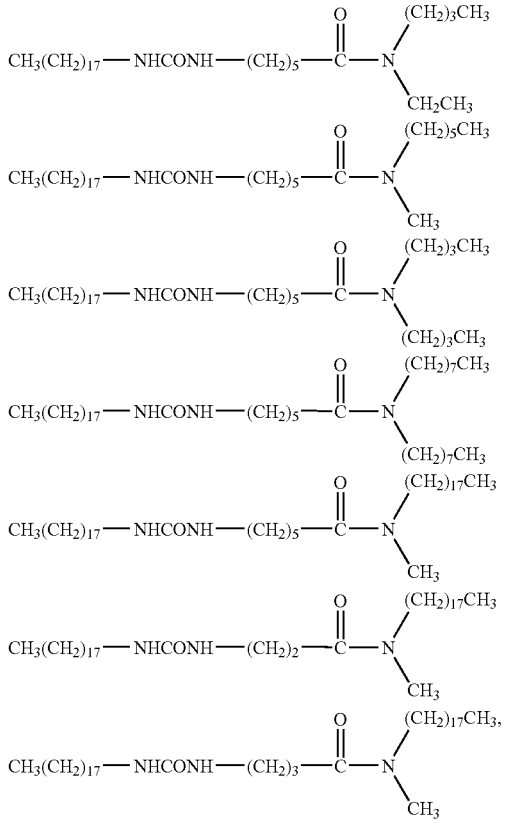

(wherein characters n, n', n'', n''' and n'''' independently represent integers of from 0 to 21. However, at least one of them is greater than 5.)

$C_{11}H_{23}CONHC_{12}H_{25}$, $C_{15}H_{31}CONHC_{16}H_{33}$, $C_{17}H_{35}CONHC_{18}H_{37}$, $C_{17}H_{35}CONHC_{18}H_{35}$,
$C_{21}H_{41}CONHC_{18}H_{37}$, $C_{15}H_{31}CONHC_{18}H_{37}$, $C_{17}H_{35}CONHCH_2HNOCC_{17}H_{35}$,
$C_{11}H_{23}CONHCH_2HNOCC_{11}H_{23}$, $C_7H_{15}CONHC_2H_4HNOCC_{17}H_{35}$, $C_9H_{19}CONHC_2H_4HNOCC_9H_{19}$,
$C_{11}H_{23}CONHC_2H_4HNOCC_{11}H_{23}$, $C_{17}H_{35}CONHC_2H_4HNOCC_{17}H_{35}$,
$(CH_3)_2CHC_{14}H_{35}CONHC_2H_4HNOCC_{14}H_{35}(CH_3)_2$, $C_{21}H_{43}CONHC_2H_4HNOCC_{21}H_{43}$,
$C_{17}H_{35}CONHC_6H_{12}HNOCC_{17}H_{35}$, $C_{21}H_{43}CONHC_6H_{12}HNOCC_{21}H_{43}$, $C_{17}H_{33}CONHC_2HNOCC_{17}H_{33}$,
$C_{17}H_{33}CONHC_2H_4HNOCC_{17}H_{33}$, $C_{21}H_{41}CONHC_2H_4HNOCC_{21}H_{41}$,
$C_{17}H_{33}CONHC_6H_{12}HNOCC_{17}H_{33}$, $C_8H_{17}NHCOC_2H_4CONHC_{18}H_{37}$, $C_{10}H_{21}NHCOC_2H_4CONHC_{10}H_{21}$,
$C_{12}H_{25}NHCOC_2H_4CONHC_{12}H_{25}$, $C_{18}H_{37}NHCOC_2H_4CONHC_{18}H_{37}$, $C_{21}H_{43}NHOCC_2H_4CONHC_{21}H_{43}$,
$C_{18}H_{37}NHOCC_6H_{12}CONHC_{18}H_{37}$, $C_{18}H_{35}NHCOC_4H_8CONHC_{18}H_{35}$,
$C_{18}H_{35}NHCOC_8H_{16}CONHC_{18}H_{35}$, $C_{12}H_{25}OCONHC_{18}H_{37}$, $C_{13}H_{27}OCONHC_{18}H_{37}$,
$C_{16}H_{33}OCONHC_{18}H_{37}$, $C_{18}H_{37}OCONHC_{18}H_{37}$, $C_{21}H_{43}OCONHC_{18}H_{37}$, $C_{12}H_{25}OCONHC_{16}H_{33}$,
$C_{13}H_{27}OCONHC_{16}H_{33}$, $C_{16}H_{33}OCONHC_{16}H_{33}$, $C_{18}H_{37}OCONHC_{16}H_{33}$, $C_{21}H_{43}OCONHC_{16}H_{33}$,
$C_{12}H_{25}OCONHC_{14}H_{29}$, $C_{13}H_{27}OCONHC_{14}H_{29}$, $C_{16}H_{33}OCONHC_{14}H_{29}$, $C_{18}H_{37}OCONHC_{14}H_{29}$,
$C_{22}H_{45}OCONHC_{14}H_{29}$, $C_{12}H_{25}OCONHC_{12}H_{37}$, $C_{13}H_{27}OCONHC_{12}H_{37}$, $C_{16}H_{33}OCONHC_{12}H_{37}$,
$C_{18}H_{37}OCONHC_{12}H_{37}$, $C_{21}H_{43}OCONHC_{12}H_{37}$, $C_{22}H_{45}OCONHC_{18}H_{37}$,
$C_{18}H_{37}NHCOOC_2H_4OCONHC_{18}H_{37}$, $C_{18}H_{37}NHCOOC_3H_6OCONHC_{18}H_{37}$
$C_{18}H_{37}NHCOOC_4H_8OCONHC_{18}H_{37}$, $C_{18}H_{37}NHCOOC_6H_{12}OCONHC_{18}H_{37}$,
$C_{18}H_{37}NHCOOC_8H_{16}OCONHC_{18}H_{37}$, $C_{18}H_{37}NHCOOC_2H_4OC_2H_4OCONHC_{18}H_{37}$,
$C_{18}H_{37}NHCOOC_3H_6OC_3H_6OCONHC_{18}H_{37}$, $C_{18}H_{37}NHCOOC_{12}H_{24}OCONHC_{18}H_{37}$,
$C_{18}H_{37}NHCOOC_2H_4OC_2H_4OC_2H_4OCONHC_{18}H_{37}$, $C_{16}H_{33}NHCOOC_2H_4OCONHC_{16}H_{33}$,
$C_{16}H_{33}NHCOOC_3H_6OCONHC_{16}H_{33}$, $C_{16}H_{33}NHCOOC_4H_8OCONHC_{16}H_{33}$,
$C_{16}H_{33}NHCOOC_6H_{12}OCONHC_{16}H_{33}$, $C_{15}H_{33}NHCCOC_8H_{16}OCONHC_{16}H_{33}$,
$C_{18}H_{37}OCOHNC_6H_{12}NHCOOC_{18}H_{37}$, $C_{16}H_{33}OCOHNC_6H_{12}NHCOOC_{16}H_{33}$,
$C_{14}H_{29}OCOHNC_6H_{12}NHCOOC_{14}H_{29}$, $C_{12}H_{25}OCOHNC_6H_{12}NHCOOC_{12}H_{25}$,
$C_{10}H_{21}OCOHNC_6H_{12}NHCOOC_1OH_{21}$, $C_8H_{17}OCOHNC_6H_{12}NHCOOC_8H_{17}$,

[Chemical formulae 12]

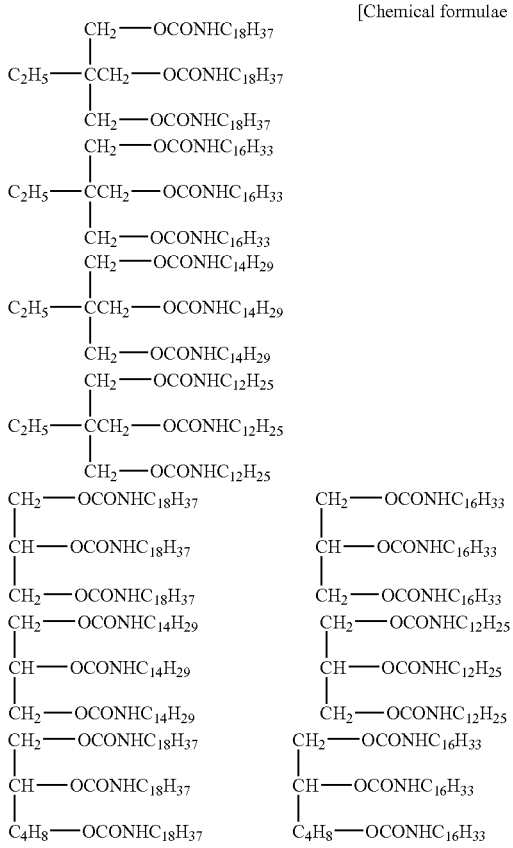

-continued

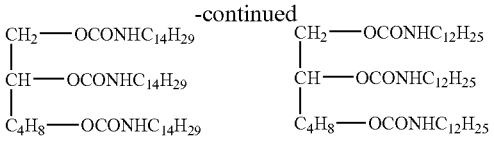

The reversible thermosensitive recording medium of the present invention is now described in detail.

Specific examples of binder resins for use in forming a reversible thermosensitive recording layer of the reversible thermosensitive recording medium of the present invention include polyvinyl chlorides, polyvinyl acetates, copolymers of a vinyl chloride and a vinyl acetate, ethyl celluloses, polystyrenes, styrene containing copolymers, phenoxy resins, polyesters, aromatic polyesters, polyurethanes, polycarbonates, polyacrylic esters, polymethacrylic esters, acrylic acid based copolymers, maleic acid based copolymers, polyvinyl alcohols, modified polyvinyl alcohols, hydroxylethyl celluloses, carboxymethyl celluloses and amylums.

The function of these binders is to maintain the uniform dispersion state of each material upon application of heat for erasing records. Therefore, it is preferred to use a binder resin having a good heat resistance property. It is good to cross-link such a binder resin by heat, ultraviolet rays, electron beams, etc.

Specific examples of such cross-linked binder resins include resins having a group reactive with a cross-linking agent such as acrylic polyol resins, polyester polyol resins, polyurethane polyol resins, phenoxy resins, polyvinyl butyral resins, cellulose acetate propionates and cellulose acetate butyrates, and copolymer resins formed of a monomer having a group reactive with a cross-linking agent and another monomer but are not limited thereto.

Acrylic polyol resins have different characteristics depending on their compositions. As hydroxyl group monomer, hydroxyethyl acrylate (HEA), hydroxypropyl acrylate (HPA), 2-hydroxyethyl methacrylate (HEMA), 2-hydroxypropyl methacrylate (HPMA), 2-hydroxybutyl monoacrylate (2-HBA), 1,4-hydroxybutyl monoacrylate (1-HBA), etc. are used. Among these, 2-hydroxyethyl methacrylate is preferably used because cracking resistance property and durability are good especially when a monomer having a primary hydroxyl group is used.

Specific examples of curing agents for use in the present invention include known isocyanates, amines, phenol, epoxy compounds, etc. Among these, isocyanate curing resins are preferably used. Specific examples of such isocyanate containing curing resins include modified compounds of known isocyanate monomers such as urethane modified compounds, allophanate modified compounds, isocyanulate modified compounds, buret modified compounds, carbodiimide modified compounds and blocked isocyanate modified compounds. Specific examples of isocyanate monomers forming such modified compounds include tolylene diisocyanate (TDI), 4,4'-diphenyl methane diisocyanate (MDI), xylylene diisocyanate (XDI), naphthylene diisocyanate (NDI), paraphenylenen diisocyanate (PPDI), tetramethyl xylylene diisocyanate (TMXDI), hexamethylene diisocyanate (HDI), dicyclo hexyl methane diisocyanate (HMDI), isophorone diisocyanate (IPDI), lysine diisocyanate (LDI), isopropylidenebis (4-cyclohexyl isocyanate) (IPC), cyclo hexyl diisocyanate (CHDI) and tolidine diisocyanate (TODI) but are not limited thereto.

In addition, a cross-linking promoter can be used as a catalyst for use in this type of reaction. Specific examples of such cross-linking promoters include tertiary amines such as 1,4-diaza-bicyclo (2, 2, 2) octane, and metal compounds such as organic tin compounds. The entire amount of a curing agent for use in cross-linking reaction is not necessarily consumed. There is no problem when some of the curing agent remains nonreacted. This type of cross-linking reaction proceeds over time. Therefore, just because there is some curing agent remaining nonreacted does not mean no cross-linking reaction has occurred. Namely, even when nonreacted curing agent is detected, it does not necessarily mean that there is no cross-linked resin. Whether or not a polymer is cross-linked can be determined by dipping a coated film in a solvent which the polymer is highly soluble. When the non cross-linked polymer in the coated film is dipped in the solvent, the non cross-linked polymer dissolves into the solvent. Thereafter, whether the polymer structure is remained in the coated film is analyzed. When the polymer structure is not confirmed in the coated film, the polymer is determined to be in non cross-linked state. This can be represented by gel ratio.

Gel ratio is a gel production ratio when resin solutes in a solvent lose their independent movement property due to interaction among the resin solutes and aggregate to form a gel. The resin preferably has a gel ratio not less than 30%, more preferably not less than 50%, further preferably not less than 70% and particularly preferably not less than 80%. When the gel ratio of a resin is too small, repetitive durability thereof deteriorates. To increase the gel ratio, it is good to mix a curing resin which is hardened by heat, ultraviolet rays, electron beams, etc., with the resin or to cross-link the resin itself.

Gel ratio can be measured by:

(1) removing the film from a substrate and measuring the initial weight of the film;

(2) pinching the film with metallic meshes having 400 meshes;

(3) dipping the film in a solvent which can dissolve the resin before cross-linking for 24 hours; and (4) measuring the weight of the film after vacuum drying the film.

The gel ratio is calculated by the following relationship.

$$\text{Gel ratio (\%)}=[\text{weight after drying (g)}/\text{the initial weight (g)}]\times 100$$

When the gel ratio is calculated using this relationship, the weight of the substances other than the resin composition in the thermosensitive layer, such as organic low molecular weight materials, is eliminated. When the weight of such other substances is uncertain, the weight can be determined by calculating the weight ratio of such other substances. The weight ratio can be determined by using the area ratio per unit area determined by observing the cross section by TEM, SEM, etc., and specific gravities of the resin and the organic low molecule materials to calculate the weight thereof. The gel ratio can be thus obtained.

When a medium comprises a substrate, a reversible thermosensitive recording layer located overlying the substrate and another layer such as a protective layer disposed on the reversible thermosensitive recording layer or between the substrate and the reversible thermosensitive recording layer, the thicknesses of the reversible thermosensitive recording layer and the other layer are determined by observing the cross section thereof by TEM, SEM, etc. before performing the gel ratio measurement mentioned above. Then, the other layer is shaved from the medium for the thickness determined by observation to expose the surface of the reversible thermosensitive recording layer. The reversible thermosensitive recording layer is removed to perform the measurement mentioned above to obtain the gel ratio thereof.

Further, when there is a protective layer formed of an ultraviolet curing resin, etc., on a reversible thermosensitive recording layer, contamination of the protective layer is necessary to be prevented as much as possible to minimize the affect to the gel ratio in this method. Therefore, it is necessary to slightly shave the surface of the reversible thermosensitive recording layer together with the protective layer.

Specific examples of leuco dyes for use in the present invention are as follows but are not limited thereto. The following leuco dyes can be used alone or in combination:

2-anilino-3-methyl-6-diethyl aminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-methyl amino)fluoran,
2-anilino-3-methyl-6-(N-isobutyl-methyl amino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino-)fluoran,
2-anilino-3-methyl-6-(N-methyl-p-toluidino-)fluoran,
2-(m-trichloromethylanilino)-3-methyl-6-dietylanimofluoran,
2-(m-trifluoromethylanilino)-3-methyl-6-dietylanimofluoran,
2-(m-trichloromethylanilino)-3-methyl-6-(N-cyclohexyl-N-methylamino)fluoran,
2-(2,4-dimethylanilino)-3-methyl-6-dietylaminofluoran,
2-(N-ethyl-p-toluidino)-3-methyl-6-(N-etylanilino)fluoran,
2-(N-ethyl-p-toluidino)-3-methyl-6-(N-propyl-p-toluidino) fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethyl aniline)-6-diethylaminofluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminoflioran,
2-chloro-6-(N-ethyl-N-isoamylamino)fluoran,
2-chloro-3-methyl-6-diethylaminofluran,
2-anilino-3-chloro-6-dietylaminofluran,
2-(o-chloroanilino)-3-chloro-6-diethlaminofluran,
2-(m-trifluoromethylanilino)-3-chloro-6-dietylaminofluran,
2-(2,3-dichloroanilino)-3-chloro-6-dietylaminofluran,
1,2-benzo-6-diethylaminofluran,
3-dietylamino-6-(m-trifluoromethylanilino)fluoran,
3-(1-ethyl-2-methylindole-3-yl)-3-(2-etoxy-4-diethylaminophenyl)-4-azphthalide,
3-(1-ethyl-2-methylindole-3-yl)-3-(2-etoxy-4-diethylaminophenyl)-7-azphthalide,
3-(1-octhyl-2-methylindole-3-yl)-3-(2-etoxy-4-diethylaminophenyl)-4-azphthalide,
3-(1-ethyl-2-methylindole-3-yl)-3-(2-methyl-4-diethylaminophenyl)-4-azphthalide,
3-(1-ethyl-2-methylindole-3-yl)-3-(2-methyl-4-diethylaminophenyl)-7-azphthalide,
3-(1-ethyl-2-methylindole-3-yl)-3-(4-diethylaminophenyl)-4-azphthalide,
3-(1-ethyl-2-methylindole-3-yl)-3-(4-N-n-amyl-N-methylaminophenyl)-4-azphthalide,
3-(1-methyl-2-methylindole-3-yl)-3-(2-hexyloxy-4-diethylaminophen yl)-4-azaphthalide,
3,3-bis(2-ethoxy-4-diethylaminphenyl)-4-azaphtalide, and
3,3-bis(2-ethoxy-4-diethylaminphenyl)-7-azaphtalide.

Specific examples of the coloring agents for use in the present invention other than the fluoran compounds and the azaphtalide compounds mentioned above include the following known leuco dyes. These can be used alone or in combination:

2-(p-acetylanilino)-6-(N-n-amyl-N-n-butylamino)fluoran,
2-benzilamino-6-(N-methyl-2,4-dimethylanilino)fluoran,
2-benzilamino-6-(N-ethyl-2,4-dimethylanilino)fluoran,
2-benzilamino-6-(N-methyl-p-toluidino)fluoran,
2-benzilamino-6-(N-ethyl-p-toluidino)fluoran,
2-(di-p-methylbenzilamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-dibutylaminofluoran,
1,2-benzo-6-(N-methyl-N-cyclohexylamino)fluoran,
1,2-benzo-6-(N-ethyl-N-toluidino)fluoran, and others.

External additives can be added to the reversible thermosensitive recording medium of the present invention to improve and control the coating properties and the coloring and discolorization properties of the recording layer of the reversible thermosensitive recording medium if appropriate. Specific examples of such external additives include surface active agents, conductive agents, filling agents, anti-oxidants, light stability agents and colorization stability agents.

A suitable ratio of a developing agent to a coloring agent varies depending on its combination. Largely, the suitable mole ratio of a developing agent to a coloring agent is from 0.1 to 20, and preferably from 0.2 to 10. When the ratio of a developing agent is too large or too small, a problem occurs in that the density of an image in a coloring state deteriorates. The ratio of an achromatic promoter to a developing agent is from 0.1 to 300% by weight and more preferably from 3 to 100% by weight. In addition, it is possible to contain a coloring agent and a developing agent in a microcapsule. The weight ratio of the resin to the coloring agent in a reversible thermosensitive recording layer is preferably from 0.1 to 10. When the ratio is too small, the reversible thermosensitive recording layer is deficient in heat resistance. When the ratio is too large, a problem occurs in that the coloring density deteriorates.

To form a recording layer, a coating liquid is used in which a mixture of the above-mentioned developing agent, the above-mentioned coloring agent, various kinds of additives mentioned above, the above mentioned curing agent and a cross-linked resin are uniformly mixed and dispersed in a coating liquid solvent.

Specific examples of such solvents for adjusting a coating liquid include: water; alcohols such as methanol, ethanol, isopropanol, n-butanol and methylisocarbinol; ketones such as acetone, 2-butanon, ethylamylketone, diacetone alcohol, isophorone and cyclohexanon; amides such as N,N-dimethyl formaldehyde and N,N-dimethylacetamide; ethers such as diethyl ether, isopropyl ether, tetrahydrofuran and 3,4-dihydro-2H-pyran; glycol ethers such as 2-methoxy ethanol, 2-ethoxy ethanol, 2-butoxy ethanol and ethylene glycol dimethylether; glycol ether acetates such as 2-methoxy ethyl acetate, 2-ethoxy ethyl acetate and 2-butoxy ethyl acetate; esters such as methyl acetate, ethyl acetate, isobutyl acetate, amyl acetate, ethyl lactate and ethylene carbonate; aromatic hydrocarbons such as benzene, toluene and xylene; aliphatic hydrocarbons such as hexane, heptane, iso-octane and cyclohexane; halogenated hydrocarbons such as methylene chloride, 1,2-dichloroethane, dichloropropane and chlorobenzene; sulfoxides such as dimethyl sulfoxide; and pyrrolidones such as N-methyl-2-pyrrolidone and N-octyl-2-pyrrolidone.

Adjustment of a coating liquid can be performed by a known coating liquid dispersion device such as a paint shaker, a ball mill, an attriter, a three-roll mill, a Keddy mill, a sand mill, a dino mill and a colloid mill. The mixed material can be dispersed in a solvent or each single material thereof can be singly mixed and dispersed in a solvent by the device mentioned above. Further, the material can be heated and fused followed by rapid cooling or gradual cooling to precipitate for dispersion.

There is no specific limit for forming a recording layer by coating. For example, the following known methods can be used: blade coating, wire bar coating, spray coating, air knife coating, bead coating, curtain coating, gravure coating, kiss coating, reverse roll coating, dip coating and dye coating.

For the substrate of the present invention, any material which can support a recording layer, for example, paper, resin films, polyethylene terephthalete (PET) films, synthetic paper, metal foil, glass and their combinations can be used. In addition, the substrate can be formed by a single layer or a plurality of such a single layer attached to each other having a thickness suitable to a purpose. A substrate is allowed to have a thickness of from a few μm to a few mm. Further, a magnetic recording layer can be provided to such a substrate on the same or opposite side of the reversible thermosensitive recording layer. In addition, the reversible thermosensitive recording medium of the present invention can be attached to another medium with an adhesive layer, etc., therebetween. Also a back coat layer can be provided on a substrate formed by PET film, etc. Further a detachment layer for use in a thermal transfer ribbon can be provided on the substrate on the opposite side of the back coat layer. The reversible thermosensitive recording layer of the present invention can be provided on the detachment layer. Furthermore, a resin layer which can be transferred to paper, resin film and PET film can be transferred on the surface of the reversible thermosensitive recording layer by a thermal transfer printer. The reversible thermosensitive recording medium of the present invention can be processed to have a sheet form, a card form, or any other form and the surface thereof is printable. Furthermore, the reversible thermosensitive recording medium can also have a non-reversible thermosensitive recording layer together with a reversible thermosensitive recording layer. In this case, coloring color tones of each recording layer are not necessarily the same.

Curing a recording layer can be performed after the recording layer is coated and dried if necessary. This curing can be performed at a relatively high temperature in a high temperature chamber, etc., for a short time or can be performed at a relatively low temperature for a long time. As for specific conditions for a cross-linking reaction, the recording layer is preferably warmed for about a minute to about 150 hours in the temperature range of from 30 to 130° C. considering the reaction property and more preferably for about two minutes to about 120 hours in the temperature range of from 40 to 100° C. However, productivity has priority in manufacturing and thus it is unfavorable to take a sufficient time to complete the cross-linking reaction. Therefore, the cross-linking process can be introduced separately from the drying process. Preferred specific cross-linking conditions are the same as above.

The reversible thermosensitive recording layer preferably has a thickness of from 1 to 20 μm, and more preferably from 3 to 15 μm.

An intermediate layer can be provided between the reversible thermosensitive recording layer and the protective layer. This is to improve adhesive property between the reversible thermosensitive recording layer and the protective layer, to prevent the recording layer from deteriorating due to the coating of the protective layer, and to prevent additives contained in the protective layer from moving to the recording layer and vice versa. The intermediate layer preferably has a thickness of from 0.1 to 20 μm, and more preferably from 0.3 to 10 μm. As for solvents for use in a coating liquid, devices for dispersing the coating liquid, binder resins, coating methods, drying/curing methods, etc., for the intermediate layer, the known mentioned above for the recording layer can be used.

The protective layer preferably has a thickness of from 0.1 to 20 μm, and more preferably from 0.3 to 10 μm. As for solvents for use in a coating liquid, devices for dispersing the coating liquid, binder resins, coating methods, drying/curing methods, etc., for the protective layer, the known mentioned above for the recording layer can be used.

It is possible to add another filler, which does not have ultraviolet absorption effect and ultraviolet shield effect, to a reversible thermosensitive recording layer, an intermediate layer and a protective layer. Such fillers can be typified into inorganic fillers and organic fillers. Specific examples of such inorganic fillers include calcium carbonate, magnesium carbonate, silicic acid anhydride, silicic acid hydrate, aluminum silicate hydrate, calcium silicate hydrate, alumina, iron oxides, calcium oxides, magnesium oxides, chrome oxides, manganese oxides, silica, talc and mica. Specific examples of such organic fillers include: silicone resins; cellulose resins; epoxy resins; nylon resins; phenol resins; polyurethane resins; urea resins; melamine resins; polyester resins; polycarbonate resins; resins containing styrenes such as styrenes, polystyrenes, polystyrene/isoprenes and styrenevinylbenzenes; resins containing acryl such as vinylidene chloride acryl, acrylic urethane and ethylene acryl; polyethylene resins; resins containing formaldehyde such as benzoguanamine formaldehyde and melamine formaldehyde; polymethyl methacrylate resins; and vinyl chloride resins. These fillers can be used alone or in combination. There is no specific limit to the combination of the inorganic fillers and the organic fillers. These fillers can have a sphere form, a particle form, a board form, a needle form, etc. The content of the filler in a protective layer is from 5 to 50% by volume.

Lubricants can be added to a reversible thermosensitive layer, an intermediate layer and a protective layer. Specific examples of such lubricants include: synthetic waxes such as ester waxes, paraffin waxes and polyethylene waxes; vegetable waxes such as hardened ricinus oil; animal oils such as hardened beef tallow oil; higher alcohols such as stearyl alcohol, behenyl alcohol; higher fatty acids such as margaric acid, lauric acid, myristic acid, palmitic acid, stearic acid and behenic acid; higher fatty acid esters such as fatty acid esters of sorbitan; amides such as stearic acid amides, oleic acid amides, lauric acid amids, ethylene bis stearic acid amides, methylene bis stearic acid amides, methylol stearic acid amides. The content of the lubricant in these layers is from 0.1 to 95% by volume, and more preferably from 1 to 75% by volume.

Figure 1:
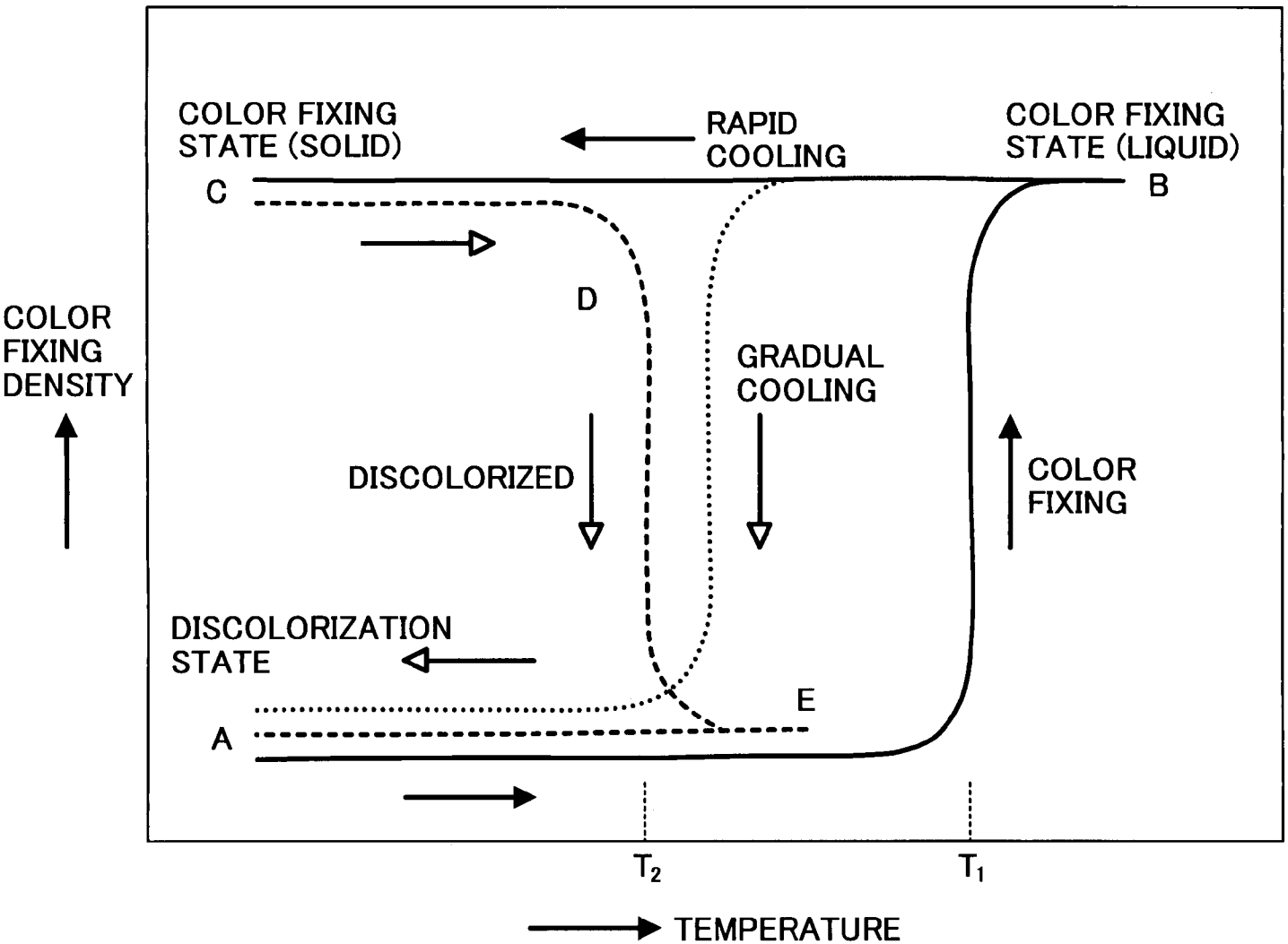
FIG. 1 is a diagram illustrating the characteristics of the coloring state and the discolorization state of the reversible thermosensitive coloring composition contained in the reversible thermosensitive recording medium of the present invention.

The reversible thermosensitive recording medium of the present invention achieves a relatively colored state and a relatively discolorized state depending on the heating temperature and/or cooling speed after heating. The basic coloring and discolorization phenomena of a composition comprising the coloring agent and the developing agent of the present invention are now described. FIG. 1 is a graph illustrating the relationship between the coloring density and the temperature. When a recording medium in a discolorization state (A) is heated, the recording medium achieves a fusion coloring state (B) at the melting point $T_1$ thereof. When the recording medium in this fusion coloring state (B) is rapidly cooled down to room temperature, the recording medium achieves a rapid cooldown coloring state (C). Whether this rapid cooldown coloring state (C) is obtained or not depends on the speed of cooldown from the fusion state. When the recording medium is gradually cooled down, the recording medium achieves the discolorization state (A) or a state having a thin density relative to that of the rapid cooldown coloring state (C). When the recording medium in the rapid cooldown coloring state (C) is heated again, the recording medium achieves a discolorization state (i.e., from D to E in FIG. 1) at a temperature ($T_2$) which is lower than the coloring temperature. When the recording medium is cooled down from this point, the recording medium achieves the discolorization state (A) again. The actual coloring temperature and discolorization temperature vary depending on the combination of a coloring agent and a developing agent used. Therefore, the combination can be arbitrarily selected to a purpose. The coloring density of the fusion coloring state is not always the same as that of the rapid cooldown coloring state.

In the recording medium of the present invention, the rapid cooldown coloring state (C) is a state in which molecules of the coloring agent and the developing agent are mixed while the molecules can be subject to reaction in contact. This state is a hardened state in most cases. In this state, the coloring agent and the developing agent aggregate and therefore can maintain the coloring state. Namely, the coloring state is stabilized by formation of this aggregation structure. In contrast, the discolorization state is a state in which molecules of the coloring agent and the developing agent are separated. In this state, the molecules of at least one of the agents aggregate and form a domain or achieve a crystalline state. Namely, the agents are stable in a separation state since at least one of the agents aggregates or achieves a crystalline state. In most cases of the present invention, a discolorization state more close to perfect discolorization state is achieved when the agents are in a phase separation state and the developing agent achieves a crystallization state. As illustrated in FIG. 1, in the discolorization occurring when the medium is gradually cooled down from the fusion coloring state (B) or is heated from the rapid cooldown coloring state (C), the aggregate structure of the agents changes in this temperature range and phase separation and crystallization of the developing agent occur.

As for the reversible thermosensitive recording label of the present invention, an adhesive layer is provided to the substrate of the reversible thermosensitive recording medium mentioned above with the substrate between the reversible thermosensitive recording label and the thermosensitive layer. There are two types of the reversible thermosensitive recording labels. These are a non-release coated paper type and a release coated paper type. In the release coated paper, a release paper is provided to the adhesive layer. Materials for use in forming the adhesive layer are typically a hot melt type.

Known materials can be typically used as materials for such an adhesive layer. Specific examples of such materials include urea resins, melamine resins, phenol resins, epoxy resins, vinyl acetate containing resins, copolymers of vinyl acetate and an acrylic compound, polyvinyl ether containing resins, copolymers of ethylene and vinyl acetate, acrylic compound containing resins, polyvinyl ether containing resins, copolymers of vinyl chloride and vinyl acetate, polystyrene copolymers, polyester containing resins, polyurethane containing resins, polyamide containing resins, chlorinated polyolefin containing resins, polyvinyl butyral containing resins, acrylic acid ester copolymers, methacrylate ester copolymers, natural rubber, cyanoacrylate resins, silicone resins but are not limited thereto.

Next, the information storage material of the present invention comprising an information storage unit and a reversible display unit is now described. The reversible display unit comprises the thermosensitive recording layer forming the reversible thermosensitive recording medium mentioned above.

There are the following three types of the information storage materials having an information storage unit and a reversible display unit:

(1) An information storage material in which a thermosensitive recording layer is provided directly on a portion of the information storage unit, i.e., the portion serving as a substrate;

(2) An information storage material in which the substrate of a reversible thermosensitive recording medium having a thermosensitive layer is attached to another substrate formed on the information storage material; and (3) An information storage material in which the reversible thermosensitive recording label mentioned above is attached to the information storage unit with the adhesive layer.

In these (1), (2) and (3), it is necessary for each of the information storage unit and the reversible display unit to function properly. If this is the case, the information storage unit can be provided to the substrate of the reversible thermosensitive medium with the substrate between the reversible thermosensitive recording layer and the information storage unit, can be provided between the substrate and the thermosensitive layer or can be provided on a portion of the thermosensitive layer.

The information storage units can be cards, discs, disc cartridges and cassette tapes but are not limited thereto.

The following are specific examples of these:

Thick cards such as IC cards and optical cards; disc cartridges which contain a rewritable disc such as flexible disks, optical magnetic discs (Mini Discs) and DVD-RAM, discs such as CD-RWs which do not use disc cartridges, write once discs such as CD-Rs, optical information recording media such as CD-RWs using phase change recording materials and video cassette tapes. Information storage materials comprising this reversible display unit and information storage unit, for example, the cards mentioned above, can display part of the information in the information storage unit at the reversible thermosensitive recording layer. This is extremely convenient for card users using such a card when compared with using a card without such a reversible thermosensitive recording layer because the card users can confirm information by just looking at the card without a dedicated device.

There is no specific limitation to such an information storage unit as long as the information storage unit can record necessary information. For example, magnetic recording, contact type ICs, non-contact type ICs and optical memory are suitable. Such a magnetic recording layer is coated on a substrate typically made of metal compounds such as iron oxides and barium ferrite and/or resins formed of vinyl chloride, urethane or nylon, or is deposited on the metal compound mentioned above without a resin by a method such as deposition and sputtering. In addition, the reversible thermosensitive recording layer in a reversible thermosensitive recording medium for use in a reversible display unit can be used as an information storage unit when information is recorded in the reversible thermosensitive recording layer in a form of barcodes, two-dimension codes, etc.

When a thick medium is used such as a vinyl chloride card with magnetic stripes which is difficult to serve as a substrate to which a reversible thermosensitive recording layer is applied, it is possible to use the reversible thermosensitive recording label mentioned in (3). The adhesive layer can be applied to the whole or part of such a thick medium. Thus, part of the information magnetically stored in such a medium can be displayed, which leads to improvement in convenience of this medium.

The reversible thermosensitive recording label containing the adhesive layer can be applied to other thick cards such as IC cards and optical cards.

In addition, this reversible thermosensitive recording label can be used instead of a display label on a disc cartridge containing a rewritable disc such as Mini Discs and DVD-RAMs.

Figure 2:
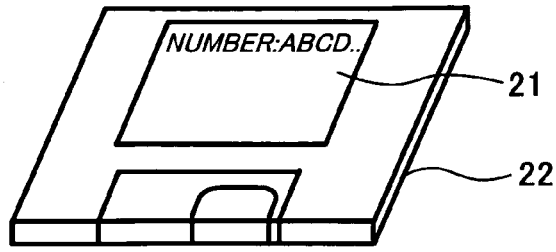
FIG. 2 is a diagram illustrating an example in which the reversible thermosensitive recording label of the present invention is attached to the disc cartridge of a Mini Disc.

FIG. 2 is a diagram illustrating an example of the reversible thermosensitive recording label (21) of the present invention applied to the Mini Disc cartridge (22). In the case of a disc such as a CD-RW which does not use a disc cartridge, it is possible to directly attach or provide a reversible thermosensitive recording label thereto. Thereby, applications such that the content of display can be automatically changed according to a change in the content of storage can be possible.

Figure 3:
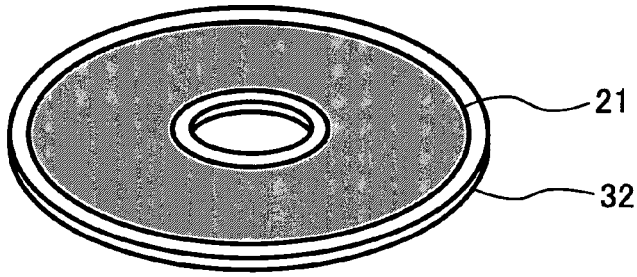
FIG. 3 is a diagram illustrating an example in which the reversible thermosensitive recording label of the present invention is attached to the surface of a CD-RW.

FIG. 3 is a diagram illustrating an example of the reversible thermosensitive recording label (21) of the present invention applied to a CD-RW (32).

It is possible to attach the reversible thermosensitive recording label (21) of the present invention to a write once disc such as CD-Rs. In addition, the content of the reversible thermosensitive recording label (21) can be rewritten and displayed according to recording in the write once disc.

Figure 4:
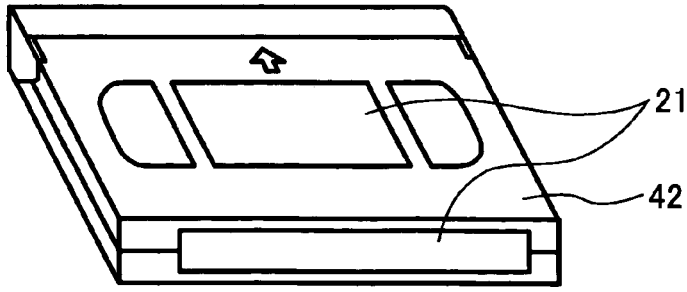
FIG. 4 is a diagram illustrating an example in which the reversible thermosensitive recording label of the present invention is attached to a video cassette tape as a display label.

Further, as illustrated in FIG. 4, the reversible thermosensitive recording label (21) of the present invention can be attached to a video cassette tape (42) as a display label.

There are methods of providing the function of reversible thermosensitive recording to the surface of a thick card, a disc cartridge and a disc other than reversible thermosensitive recording label attachment thereto. These are, for example, a method of directly coating a reversible thermosensitive recording layer to the surface of a thick card, a disc cartridge and a disc and a method of forming a reversible thermosensitive recording layer on another substrate and transferring the layer to the surface thereof. In the case of the method of layer transferring, an adhesive layer of, for example, hot melt type, can be provided on a reversible thermosensitive recording layer.

When a reversible thermosensitive recording label is attached to or a reversible thermosensitive recording layer is provided to an inflexible material such as a thick card, a disc, a disc cartridge and a cassette tape, it is preferred to provide a layer or sheet having elasticity and functioning as a cushion between the label or the layer and the inflexible material. Thereby, contact property between a thermal head and the label or the layer can be improved, resulting in formation of a uniform image.

In the present invention, there are also provided an image processing method of forming and/or erasing images upon application of heat by using the reversible thermosensitive recording medium, the information storage medium or the reversible thermosensitive recording label mentioned above, and an image processing device comprising the reversible thermosensitive recording medium, the information storage medium or the reversible thermosensitive recording label mentioned above. The image processing device forms and/or erases images upon application of heat.

To form an image on the medium, etc., mentioned above, an image recording device such as a thermal head and a laser beam which can partially heat the image on the medium is used. To erase an image on a medium, an image erasing device such as a hot stamp, a ceramic heater, a heat roller, a hot air, a thermal head and a laser beam is used. Among these, a ceramic heater is preferably used. By using a ceramic heater, an erasing device can be reduced in size and the erasure state is stabilized, resulting in formation of an image having a good contrast. The temperature of a ceramic heater is preferably not less than 100° C., more preferably not less than 110° C. and further preferably not less than 115° C.

By using a thermal head, the entire size of a device comprising the thermal head can be further reduced and the power consumption thereof is reduced. In addition, a battery-operated handy device can be used. When image formation and erasure can be performed by one thermal head, further size reduction is possible. In the case of a thermal head which can form and erase an image, it is allowed to first erase all the images recorded and then form new images, or erase the image recorded and then record a new image while changing energy (overwriting system). In the overwriting system, the total time needed to be taken to form and erase an image can be short, resulting in speeding up of recording. To realize this speeding up, it is necessary to smooth the surface of a recording layer and uniformly disperse each material for use in each layer. This is achieved in the present invention.

When a card comprising a reversible thermosensitive recording layer and an information recording unit is used, the device mentioned above contains a device reading stored information in the information recording unit and a device writing information therein.

Figure 5:
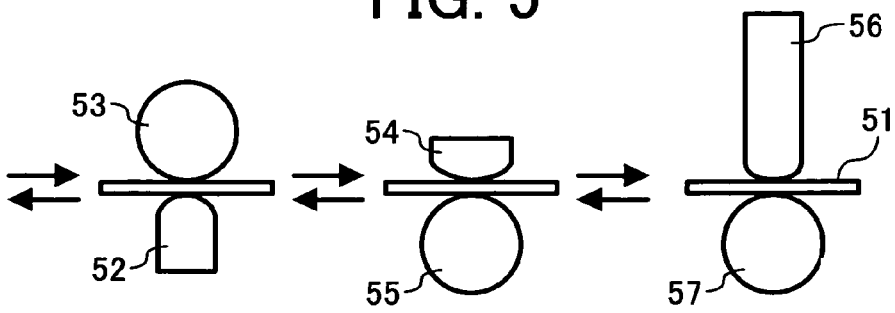
FIG. 5 is a diagram illustrating an embodiment of the image processing device of the present invention.

FIG. 5 is a diagram illustrating the image processing device of the present invention. Further, FIG. 5 is a schematic diagram illustrating an example of the device of the present invention which erases and forms an image by a ceramic heater and a thermal head, respectively.

In the image processing device illustrated in FIG. 5, information recorded in the magnetic recording layer in a recording medium is first read by a magnetic head. Then, the image already recorded in the reversible thermosensitive recording layer is erased by the ceramic heater upon application of heat. Further, new information processed based on the information read by the magnetic head is recorded in the reversible thermosensitive recording layer by the thermal head. Thereafter, the information read by the magnetic head is rewritten by the new information.

Namely, in the image processing device illustrated in FIG. 5, a reversible thermosensitive recording medium (51) having a magnetic recording layer with its substrate between the reversible thermosensitive recording medium (51) and the magnetic recording layer is transferred back and forth along a transfer path indicated by arrows.

Information is magnetically recorded or erased in the magnetic recording layer of a reversible thermosensitive layer while the reversible thermosensitive recording medium (51) is transferred between a magnetic head (52) and a transfer roller (53). The reversible thermosensitive recording medium (51) is heat-processed to erase the image while the reversible thermosensitive recording medium (51) is transferred between a ceramic heater (54) and a transfer roller (55). An image is formed on the reversible thermosensitive recording medium (51) while the reversible thermosensitive recording medium (51) is transferred between a thermal head (56) and a transfer roller (57) and then the reversible thermosensitive recording medium (51) is discharged out of the device. Rewriting magnetic information can be performed before or after image-erasing performed by the ceramic heater (54). In addition, after the reversible thermosensitive recording medium (51) has passed between the ceramic heater (54) and the transfer roller (55) or between the thermal head (56) and the transfer roller (57), the reversible thermosensitive recording medium (51) can be transferred back along the transfer path and heat processing by the ceramic heater (54) and printing by the thermal head (56) can be performed again.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example

Next embodiments of the present invention are now described in detail.

<Preparation of Hollow Particle A)

(1) Dissolve 55 g of sodium chloride in 160 g of ion exchanged water;

(2) Add 1.0 g of a condensation product of adipic acid and diethanol amine and 25 g of 20% collidal silica aqueous solution;

(3) Adjust pH of the obtained solution by sulfuric acid to be in the range of from pH 3.8 to pH 4.2 and uniformly mix to obtain an aqueous phase;

(4) Mix, stir and dissolve 45 g of acrylic nitrile, 16 g of methacrylonitrile, 5 g of N-methylolacrylic amide, 23 g of isobornyl methacrylate, 0.1 g of ethylene glycol dimethacryate, 0.3 g of azobisisobutylol nitrile, 0.1 g of 1,1-azobis(cyclohexane-1-carbonitrile)(V-40) and 15 g of isobutene to obtain an oil phase;

(5) Mix the water phase and the oil phase and stir it with a homomixer at 4,000 rpm for one minute to obtain a suspension;

(6) Move the suspension to a separable flask;

(7) Subsequent to nitrogen replacement, react the suspension at 70° C. for 6 hours and at 90° C. for 14 hours while stirring;

(8) Subsequent to cooling, filtrate the resultant to obtain capsule particles; and (9) Foam the capsule particles by heat to form hollow particles.

The values of the hollow particle, i.e., Tg, hollow ratio, D100 (maximum particle diameter thereof), and the ratio (D100/D50) (i.e., D100 to a 50% cumulative particle diameter (D50) are shown in Table 1.

TABLE 1

| | Tg (° C.) | Hollow ratio (%) | D100 (μm) | D100/D50 |
|---|---|---|---|---|
| Hollow particle A | 105 | 89 | 10.0 | 2.2 |
| Hollow particle B | 105 | 91 | 9.0 | 2.0 |
| Hollow particle C | 104 | 90 | 9.0 | 2.1 |
| Hollow particle D | 105 | 89 | 10.0 | 3.5 |
| Hollow particle E | 104 | 85 | 9.0 | 2.9 |
| Hollow particle F | 104 | 70 | 9.0 | 2.8 |
| Hollow particle G | 43 | 89 | 10.0 | 3.1 |

Example 1

| <Preparation of intermediate layer> | |
|---|---|
| Water dispersion liquid (solid content density: 30%) of hollow particle (Hollow particle A in Table 1) | 30 parts |
| Polyurethane resin emulsion (solid content density: 35%, SUPERFLEX ® 150 manufactured by Dai-Ichi Kogyo Seiyaku Co., Ltd.) | 28 parts |
| Completely saponified polyvinyl alcohol (solid content density: 16%) | 9 parts |
| Water | 50 parts |

The mixture of the material mentioned above was stirred and dispersed to obtain an intermediate layer coating liquid. The intermediate layer coating liquid was coated on a white polyethylene terephthalate (PET) film with a magnetic layer (manufactured by Dainippon Ink and Chemicals, Inc.) having a thickness of about 250 μm by using a wire bar. The coated layer was dried at 115° C. for 1 minute to obtain an intermediate layer having a thickness of about 6.0 μm.

| <Preparation of reversible thermosensitive recording layer> | |
|---|---|
| 2-anilino-3-methyl-6-diethylamino fluoran | 2 parts |
| A developing agent having the following structure | 8 parts |

[Chemical formula 13]

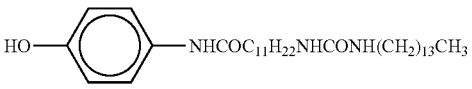

-continued

| <Preparation of reversible thermosensitive recording layer> | |
|---|---|
| A control agent having the following structure [Chemical formula 14] $C_{15}H_{31}CONHC_{16}H_{33}$ | 2 parts |
| 15% tetrahydrofuran (THF) solution of an acrylic polyol resin (hydroxyl value: 70, oxygen value: not greater than 1.0, molecular weight: 35,000, glass transition temperature: 52° C., hydroxyl group monomer: 2-hydroxyethyl methacrylate) | 150 parts |
| COLONATE ® HL (manufactured by Nippon Polyurethane Industry Co., Ltd.) | 10 parts |

The constitute mentioned above was pulverized and dispersed with a ball mill to obtain particles having an average particle diameter of from 0.1 to 3 μm.

A reversible thermosensitive recording layer coating liquid was adjusted from the obtained dispersed liquid.

The reversible thermosensitive recording layer coating liquid was coated on the intermediate layer by using a wire bar. The coated layer was dried at 115° C. for 1 minute and heated at 60° C. for 36 hours to obtain a reversible thermosensitive recording layer having a thickness of about 11.0 μm.

| <Preparation of protective layer> | |
|---|---|
| Urethane acrylate containing ultraviolet curing resin (C7-157, manufactured by Dainippon Ink and Chemicals, Inc.) | 15 parts |
| Ethyl acetate | 85 parts |

The composition mentioned above was well stirred to obtain a protective layer coating liquid. This protective coating liquid was coated on the recording layer mentioned above by using a wire bar. The coated layer was dried at 90° C. for 1 minute. The coated layer was cured while transferred at 9 m/min. under an ultraviolet lamp having an irradiation energy of 80 W/cm to obtain a protective layer having a thickness of about 3 μm. The reversible thermosensitive recording medium of the present invention was thus obtained.

Example 2

A reversible thermosensitive recording medium was manufactured in the same manner as in Example 1 except that a hollow particle B was used in lieu of the hollow particle A.

Example 3

A reversible thermosensitive recording medium was manufactured in the same manner as in Example 1 except that a hollow particle C was used in lieu of the hollow particle A.

Example 4

A reversible thermosensitive recording medium was manufactured in the same manner as in Example 1 except that a hollow particle D was used in lieu of the hollow particle A.

Example 5

A reversible thermosensitive recording medium was manufactured in the same manner as in Example 1 except that an acrylic resin emulsion (solid content density: 35%, JONCRYL 538, manufactured by Johnson Polymer Corporation) was used in lieu of the polyurethane resin emulsion (SUPERFLEX® 150 manufactured by Dai-Ichi Kogyo Seiyaku Co., Ltd.) of Example 1.

Example 6

A reversible thermosensitive recording medium was manufactured in the same manner as in Example 1 except that the intermediate layer was prepared by the following method.

| <Preparation of intermediate layer 2> | |
|---|---|
| Water dispersion liquid (solid content density: 30%) of hollow particle (Hollow particle A in Table 1) | 30 parts |
| Urethane acrylate containing ultraviolet curing resin emulsion (solid content density: 35%/Beamset EM-90, manufactured by Arakawa Chemical Industries, Ltd.) | 28 parts |
| Darocure 1173 | 0.5 parts |
| Completely saponified polyvinyl alcohol aqueous solution (solid content density: 16%) | 9 parts |
| Water | 50 parts |

The mixture of the material mentioned above was stirred and dispersed to obtain an intermediate layer coating liquid. The intermediate layer coating liquid was coated on a white polyethylene terephthalate (PET) film with a magnetic layer (manufactured by Dainippon Ink and Chemicals, Inc.) having a thickness of about 250 μm by using a wire bar. Subsequent to drying at 90° C. for 1 minute, the coated layer was cured while transferred at 9 m/min. under an ultraviolet lamp having an irradiation energy of 80 W/cm to obtain an intermediate layer having a thickness of about 6 μm.

Example 7

A reversible thermosensitive recording medium was manufactured in the same manner as in Example 6 except that urethane acrylate containing ultraviolet curing resin emulsion (solid content density: 35%, DW7825 manufactured by Daicel UCB Company Ltd.) in lieu of urethane acrylate containing ultraviolet curing resin emulsion (solid content density: 35%, Beamset EM-90, manufactured by Arakawa Chemical Industries, Ltd.)

Example 8

A reversible thermosensitive recording medium was manufactured in the same manner as in Example 1 except that a hollow particle E was used in lieu of the hollow particle A.

Example 9

A reversible thermosensitive recording medium was manufactured in the same manner as in Example 1 except that a hollow particle F was used in lieu of the hollow particle A.

COMPARATIVE EXAMPLE 1

A reversible thermosensitive recording medium was manufactured in the same manner as in Example 1 except that a hollow particle G was used in lieu of the hollow particle A.

COMPARATIVE EXAMPLE 2

A reversible thermosensitive recording medium was manufactured in the same manner as in Example 1 except that Fuji balloon S35 (manufactured by Fuji Silysia Chemical Ltd.) having a particle diameter of 40 μm was used in lieu of the hollow particle A.

COMPARATIVE EXAMPLE 3

A reversible thermosensitive recording medium was manufactured in the same manner as in Example 1 except that micropearl F-30 (manufactured by Matsumoto Yushi-Seiyaku Co., Ltd.) having a particle diameter of 20 μm was used in lieu of the hollow particle A.

COMPARATIVE EXAMPLE 4

A reversible thermosensitive recording medium was manufactured in the same manner as in Example 1 except that ROPAQUE® HP-91 (manufactured by Rohm and Haas Company) was used in lieu of the hollow particle A.

COMPARATIVE EXAMPLE 5

A reversible thermosensitive recording medium was manufactured in the same manner as in Example 1 except that no intermediate layer was provided.

(Evaluation Method)

(1) Image density, Erasure density, Erasable energy range width Printing and erasing were performed on the manufactured reversible thermosensitive recording medium by a thermosensitive print simulator (manufactured by Yashiro Inc.) using an end face type thermal head (EUX-ET8A9AS1, manufactured by Matsushita Electronic Components Co., Ltd.) having a resistance of 1152 Ω under the following conditions. The density was measured by a Macbeth RD-914 densitometer.

Evaluation condition: pulse width; 2 ms, line cycle; 2.86 ms, printing speed; 43.10 mm/s, sub-scanning density; 8 dot/mm Image density: maximum density obtained when printed while applied energy was changed in the range of from 0.25 mJ/dot to 0.62 mJ/dot.

Erasure density: minimum erasure density obtained when a solid image printed with the applied energy for the maximum density for the image density mentioned above was erased while applied energy was changed in the range of from 0.15 mJ/dot to 0.52 mJ/dot to change the voltage.

Erasable energy range width: energy width in which the erasure density is not greater than 0.3 for the erasure density evaluation mentioned above.

(2) Whiteout: the colored image for the image density evaluation mentioned above was observed with a naked eye to determine the degree of whiteout:

G: no whiteout was observed

Figure 7:
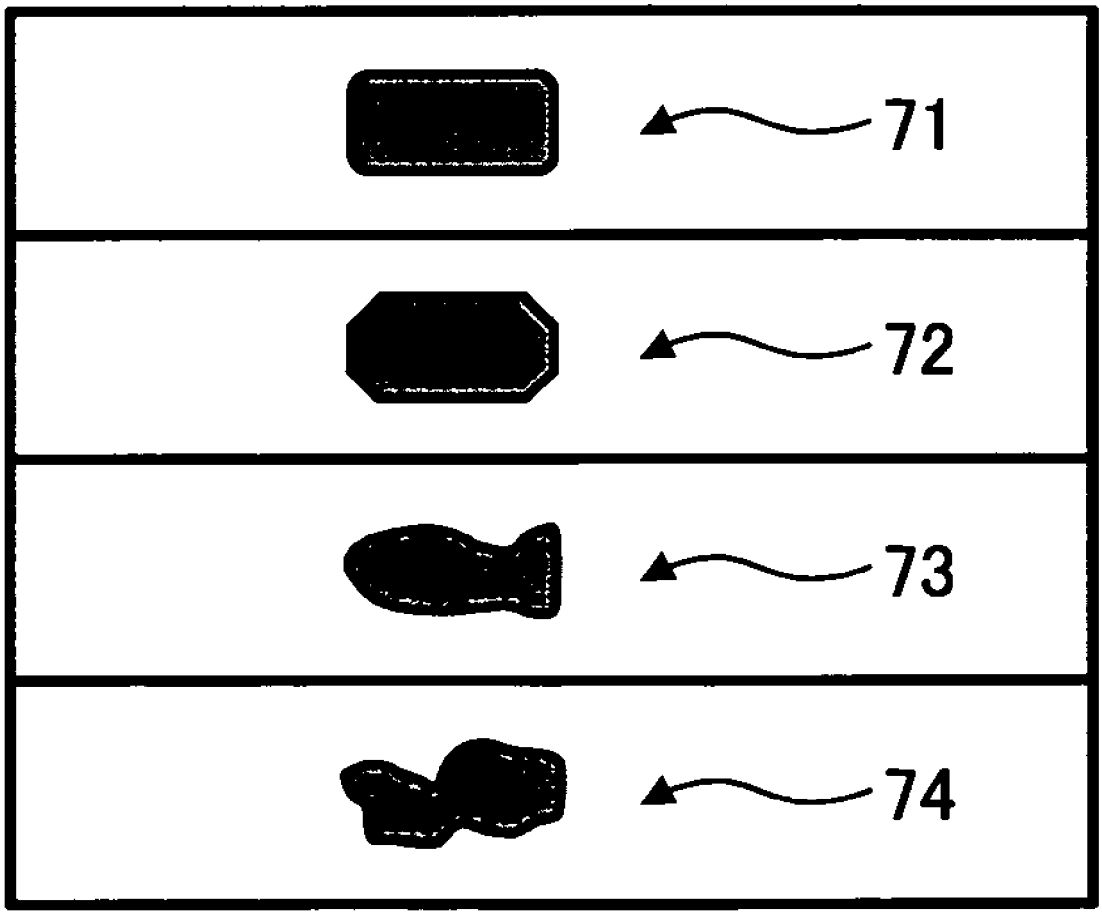
FIG. 7 is an illustration of the "Excellent", "Good", "Not Good"and "Bad" image figures for one dot referred to in Table 2 below.

B: whiteout was observed (3) Fineness reproducibility: a printed image having an image density of 0.6 for the printed samples used in the image density evaluation mentioned above was observed by a microscope to determine the degree of fineness of one dot printing reproducibility. Fineness reproducibility is good when the shape observed is close to the shape of a dot, i.e., a square (refer to Table 2 and FIG. 7).

TABLE 2

| Rank | | Image figure of one dot |
|---|---|---|
| Excellent | Close to square | (See FIG. 7) |
| Good | Somewhat roundish | (See FIG. 7) |
| Not good | Slightly irregular form due to whiteout | (See FIG. 7) |
| Bad | Irregular form | (See FIG. 7) |

TABLE 3

| | Image density | Erasure density | Erasable energy range width (mj/dot) | Whiteout | Fineness reproducibility |
|---|---|---|---|---|---|
| Example 1 | 1.36 | 0.15 | 0.11 | G | Excellent |
| Example 2 | 1.32 | 0.16 | 0.10 | G | Excellent |
| Example 3 | 1.30 | 0.14 | 0.12 | G | Excellent |
| Example 4 | 1.22 | 0.14 | 0.12 | G | Excellent |
| Example 5 | 1.28 | 0.14 | 0.10 | G | Good |
| Example 6 | 1.30 | 0.15 | 0.12 | G | Excellent |
| Example 7 | 1.29 | 0.14 | 0.11 | G | Excellent |
| Example 8 | 1.26 | 0.16 | 0.10 | G | Excellent |
| Example 9 | 1.25 | 0.19 | 0.10 | G | Not good |
| Comparative Example 1 | 1.26 | 0.21 | 0.05 | G | Not good |
| Comparative Example 2 | 1.20 | 0.31 | 0.00 | B | Not good |
| Comparative Example 3 | 1.18 | 0.31 | 0.00 | B | Not good |
| Comparative Example 4 | 1.25 | 0.30 | 0.00 | G | Not good |
| Comparative Example 5 | 1.08 | 0.39 | 0.00 | G | Bad |

This document claims priority and contains subject matter related to Japanese Patent Application No. JPAP2003-420942 filed on Dec. 18, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A reversible thermosensitive recording medium, comprising:

a substrate;

a recording layer configured to reversibly record and erase an image therein and located overlying the substrate, the recording layer comprising:

a first binder resin; and a reversible thermosensitive coloring composition, comprising:

an electron donating coloring compound; and an electron accepting compound comprising a phenol compound comprising a long chain aliphatic group having at least 10 carbon atoms and an active hydrogen containing group capable of forming a hydrogen bonding, an intermediate layer located between the substrate and the recording layer, the intermediate layer comprising:

a second binder resin; and a content of hollow particles having a hollow ratio not less than 70%, a maximum particle diameter (D100) of from 5.0 to 10.0 μm and a ratio (D100/D50) of the maximum particle diameter thereof (D100) to a 50% cumulative particle diameter thereof (D50) of from 2.0 to 3.0, wherein the recording layer achieves and maintains a colored state when heated to a temperature not lower than a melting point thereof and then cooled down, and the recording layer achieves and maintains a discolorization state when heated to a temperature lower than the melting point and then cooled down, and wherein the recording layer has an erasable energy range width of at least 0.1 mJ/dot when achieving the discolorization state with a thermal head.

2. The reversible thermosensitive recording medium according to claim 1, wherein the hollow particles comprise at least one of an acrylonitrile copolymer and a methacrylonitrile copolymer.

3. The reversible thermosensitive recording medium according to claim 1, wherein the hollow particles comprise a copolymer comprising a unit obtained from a monomer represented by the following chemical formula (1):

(1)

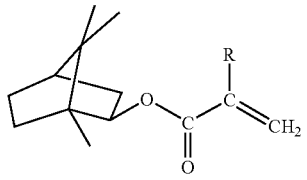

wherein R represents a hydrogen atom or a methyl group.

4. The reversible thermosensitive recording medium according to claim 1, wherein the second binder resin includes a resin selected from hydrophobic resins, ultraviolet curing resins and water soluble resins.

5. The reversible thermosensitive recording medium according to claim 1, wherein a weight ratio of the second binder resin to the content of hollow particles is 1/1to 2/1.

6. The reversible thermosensitive recording medium according to claim 1, wherein the electron accepting compound is a compound represented by the following chemical formula (2):

(2)

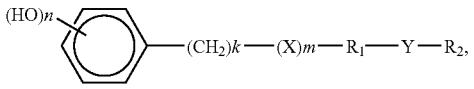

wherein k represents 0 or an integer of from 1 to 2; m represents 0 or 1; and n represents an integer of from 1 to 3, X and Y independently represent a divalent group having a nitrogen atom or an oxygen atom, $R_1$ represents an aliphatic hydrocarbon group having at least two carbon atoms which can optionally have a substitute group and $R_2$ represents an aliphatic hydrocarbon group having at least one carbon atom.

7. The reversible thermosensitive recording medium according to claim 1, wherein the recording layer further comprises an achromatic promoter.

8. The reversible thermosensitive recording medium according to claim 1, further comprising a protective layer located overlying the recording layer, the protective layer comprising a cross-linked resin.

9. An information storage material comprising:

an information storage unit; and a reversible display unit, comprising:

a reversible thermosensitive recording layer comprising:

a binder resin; and a reversible thermosensitive coloring composition, comprising:

an electron donating coloring compound; and an electron accepting compound comprising a phenol compound comprising a long chain aliphatic group having at least 10 carbon atoms and an active hydrogen containing group capable of forming a hydrogen bonding; and an intermediate layer located between the information storage unit and the recording layer, the intermediate layer comprising:

a second binder resin; and a content of hollow particles having a hollow ratio not less than 70%, a maximum particle diameter (D100) of from 5.0 to 10.0 μm and a ratio (D100/D50) of the maximum particle diameter thereof (D100) to a 50% cumulative particle diameter thereof (D50) of from 2.0 to 3.0, wherein the recording layer achieves and maintains a colored state when heated to a temperature not lower than a melting point thereof and then cooled down, and the recording layer achieves and maintains a discolorization state when heated to a temperature lower than the melting point and then cooled down, and wherein the recording layer has an erasable energy range width of at least 0.1 mJ/dot when achieving the discolorization state with a thermal head.

10. The information storage material according to claim 9, wherein the information storage unit is one selected from the group consisting of a card, a disc, a disc cartridge and a cassette tape.

11. The information storage material according to claim 10, wherein the reversible display unit further comprises:

a substrate having opposite sides and configured to bear the reversible thermosensitive recording layer on one of said sides; and an adhesive layer disposed on a side of the substrate opposite to the side that bears the reversible thermosensitive recording layer.

12. A reversible thermosensitive recording label, comprising:

the reversible thermosensitive recording medium of claim 1, said substrate having opposite sides one of which bears the reversible thermosensitive recording layer; and an adhesive layer disposed on a side of the substrate opposite to the side that bears the reversible thermosensitive recording layer.

13. An image processing method, comprising:

erasing a recorded image in the recording layer of the reversible thermosensitive recording medium of claim 1 by heating the recording layer to a temperature lower than the melting point thereof.

14. The image processing method according to claim 13, wherein the image erasing is performed using a thermal head or a ceramic heater.

15. The image processing method according to claim 13, further comprising:

recording an image in the recording layer by heating the recording layer to a temperature not lower than a melting point thereof.

16. The image processing method according to claim 15, wherein the image recording is performed using a thermal head.

17. An image processing method, comprising:

recording an image in the recording layer of the reversible thermosensitive recording medium of claim 1 by heating the recording layer to a temperature not lower than the melting point thereof.

18. The image processing method according to claim 17, wherein the image recording is performed using a thermal head.

19. An image processing device, comprising:

an image erasing device configured to erase a recorded image in the recording layer of the reversible thermosensitive recording medium of claim 1.

20. The image processing device according to claim 19, wherein the image erasing is performed using a thermal head or a ceramic heater.

21. The image processing device according to claim 19, further comprising an image recording device configured to record an image in the recording layer of the reversible thermosensitive recording medium of claim 1.

22. The image processing device according to claim 21, wherein the image recording is performed using a thermal head.

23. An image processing device, comprising:

an image recording device configured to record an image in the recording layer of the reversible thermosensitive recording medium of claim 1.

24. The image processing device according to claim 23, wherein the image recording is performed using a thermal head.

* * * * *